US010378540B2

(12) United States Patent
Stover

(10) Patent No.: US 10,378,540 B2
(45) Date of Patent: Aug. 13, 2019

(54) COMPRESSOR WITH THERMALLY-RESPONSIVE MODULATION SYSTEM

(71) Applicant: Emerson Climate Technologies, Inc., Sidney, OH (US)

(72) Inventor: Robert C. Stover, Versailles, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 182 days.

(21) Appl. No.: 15/187,225

(22) Filed: Jun. 20, 2016

(65) Prior Publication Data

US 2017/0030354 A1 Feb. 2, 2017

Related U.S. Application Data

(60) Provisional application No. 62/198,399, filed on Jul. 29, 2015, provisional application No. 62/187,350, filed on Jul. 1, 2015.

(51) Int. Cl.

| | |
|---|---|
| ***F04C 27/00*** | (2006.01) |
| ***F04C 18/02*** | (2006.01) |
| ***F04C 28/26*** | (2006.01) |
| ***F04C 29/12*** | (2006.01) |
| ***F04C 23/00*** | (2006.01) |

(52) U.S. Cl.

CPC ..... *F04C 27/005* (2013.01); *F04C 18/0215* (2013.01); *F04C 23/008* (2013.01); *F04C 28/26* (2013.01); *F04C 29/124* (2013.01); *F04C 2240/30* (2013.01); *F04C 2240/81* (2013.01);

(Continued)

(58) Field of Classification Search

CPC ..... F04C 2270/195

See application file for complete search history.

(56) References Cited

U.S. PATENT DOCUMENTS 4,058,988 A 11/1977 Shaw
4,216,661 A 8/1980 Tojo et al.

(Continued)

FOREIGN PATENT DOCUMENTS

CN 1137614 A 12/1996
CN 1158944 A 9/1997

(Continued)

OTHER PUBLICATIONS

U.S. Appl. No. 15/187,016, filed Jan. 26, 2018, Masao Akei et al.

(Continued)

*Primary Examiner* — Mary Davis

(74) *Attorney, Agent, or Firm* — Harness, Dickey & Pierce, P.L.C.

(57) ABSTRACT

A compressor may include a first scroll, a second scroll and a modulation system. The first scroll may include a first endplate and a first spiral wrap. The second scroll may include a second endplate and a second spiral wrap interleaved with the first spiral wrap and cooperating to form a plurality of working fluid pockets therebetween. The modulation system may include a temperature-responsive displacement member that actuates in response to a temperature within a space rising above a predetermined threshold. Actuation of the displacement member may be controlled to control a capacity of the compressor.

11 Claims, 12 Drawing Sheets

(52) U.S. Cl.
CPC .. *F04C 2270/195* (2013.01); *F05C 2251/046* (2013.01); *F05C 2251/08* (2013.01)

(56) References Cited

U.S. PATENT DOCUMENTS 4,382,370 A 5/1983 Suefuji et al.
4,383,805 A 5/1983 Teegarden et al.
4,389,171 A 6/1983 Eber et al.
4,475,360 A 10/1984 Suefuji et al.
4,497,615 A 2/1985 Griffith
4,545,742 A 10/1985 Schaefer
4,580,949 A 4/1986 Maruyama et al.
4,609,329 A 9/1986 Pillis et al.
4,696,630 A 9/1987 Sakata et al.
4,727,725 A 3/1988 Nagata et al.
4,774,816 A 10/1988 Uchikawa et al.
4,818,195 A 4/1989 Murayama et al.
4,846,633 A 7/1989 Suzuki et al.
4,877,382 A 10/1989 Caillat et al.
4,886,425 A 12/1989 Itahana et al.
4,940,395 A 7/1990 Yamamoto et al.
5,040,952 A 8/1991 Inoue et al.
5,055,010 A 10/1991 Logan
5,059,098 A 10/1991 Suzuki et al.
5,071,323 A 12/1991 Sakashita et al.
5,074,760 A 12/1991 Hirooka et al.
5,080,056 A 1/1992 Kramer et al.
5,085,565 A 2/1992 Barito
RE34,148 E 12/1992 Terauchi et al.
5,169,294 A 12/1992 Barito
5,192,195 A 3/1993 Iio et al.
5,193,987 A 3/1993 Iio et al.
5,240,389 A 8/1993 Oikawa et al.
5,253,489 A 10/1993 Yoshii
5,356,271 A 10/1994 Miura et al.
5,451,146 A 9/1995 Inagaki et al.
5,482,637 A 1/1996 Rao et al.
5,551,846 A 9/1996 Taylor et al.
5,557,897 A 9/1996 Kranz et al.
5,562,426 A 10/1996 Watanabe et al.
5,577,897 A 11/1996 Inagaki et al.
5,607,288 A 3/1997 Wallis et al.
5,611,674 A 3/1997 Bass et al.
5,613,841 A 3/1997 Bass et al.
5,639,225 A 6/1997 Matsuda et al.
5,640,854 A 6/1997 Fogt et al.
5,674,058 A 10/1997 Matsuda et al.
5,678,985 A 10/1997 Brooke et al.
5,707,210 A 1/1998 Ramsey et al.
5,722,257 A 3/1998 Ishii et al.
5,741,120 A 4/1998 Bass et al.
5,855,475 A 1/1999 Fujio et al.
5,885,063 A 3/1999 Makino et al.
5,993,171 A 11/1999 Higashiyama
5,993,177 A 11/1999 Terauchi et al.
6,047,557 A 4/2000 Pham et al.
6,086,335 A 7/2000 Bass et al.
6,095,765 A 8/2000 Khalifa
6,102,671 A 8/2000 Yamamoto et al.
6,123,517 A 9/2000 Brooke et al.
6,123,528 A 9/2000 Sun et al.
6,132,179 A 10/2000 Higashiyama
6,139,287 A 10/2000 Kuroiwa et al.
6,139,291 A 10/2000 Perevozchikov
6,149,401 A 11/2000 Iwanami et al.
6,164,940 A 12/2000 Terauchi et al.
6,176,686 B1 1/2001 Wallis et al.
6,179,589 B1 1/2001 Bass et al.
6,202,438 B1 3/2001 Barito
6,210,120 B1 4/2001 Hugenroth et al.
6,213,731 B1 4/2001 Doepker et al.
6,231,316 B1 5/2001 Wakisaka et al.
6,267,565 B1 * 7/2001 Seibel ..... F04C 28/28 417/292
6,273,691 B1 8/2001 Morimoto et al.
6,293,767 B1 9/2001 Bass
6,293,776 B1 9/2001 Hahn et al.
6,322,340 B1 11/2001 Itoh et al.
6,350,111 B1 2/2002 Perevozchikov et al.
6,379,123 B1 4/2002 Makino et al.
6,412,293 B1 7/2002 Pham et al.
6,413,058 B1 7/2002 Williams et al.
6,419,457 B1 7/2002 Seibel et al.
6,428,286 B1 8/2002 Shimizu et al.
6,454,551 B2 9/2002 Kuroki et al.
6,457,948 B1 10/2002 Pham
6,464,481 B2 10/2002 Tsubai et al.
6,478,550 B2 11/2002 Matsuba et al.
6,506,036 B2 1/2003 Tsubai et al.
6,537,043 B1 3/2003 Chen
6,544,016 B2 4/2003 Gennami et al.
6,558,143 B2 5/2003 Nakajima et al.
6,589,035 B1 7/2003 Tsubono et al.
6,679,683 B2 1/2004 Seibel et al.
6,715,999 B2 4/2004 Ancel et al.
6,769,881 B2 8/2004 Lee
6,769,888 B2 8/2004 Tsubono et al.
6,773,242 B1 8/2004 Perevozchikov
6,817,847 B2 11/2004 Agner
6,821,092 B1 11/2004 Gehret et al.
6,863,510 B2 3/2005 Cho
6,881,046 B2 4/2005 Shibamoto et al.
6,884,042 B2 4/2005 Zili et al.
6,893,229 B2 5/2005 Choi et al.
6,896,498 B1 5/2005 Patel
6,913,448 B2 7/2005 Liang et al.
6,984,114 B2 1/2006 Zili et al.
7,018,180 B2 3/2006 Koo
7,029,251 B2 4/2006 Chang et al.
7,118,358 B2 10/2006 Tsubono et al.
7,137,796 B2 11/2006 Tsubono et al.
7,160,088 B2 1/2007 Peyton
7,207,787 B2 4/2007 Liang et al.
7,229,261 B2 6/2007 Morimoto et al.
7,255,542 B2 8/2007 Lifson et al.
7,261,527 B2 8/2007 Alexander et al.
7,311,740 B2 12/2007 Williams et al.
7,344,365 B2 3/2008 Takeuchi et al.
RE40,257 E 4/2008 Doepker et al.
7,354,259 B2 4/2008 Tsubono et al.
7,364,416 B2 4/2008 Liang et al.
7,371,057 B2 5/2008 Shin et al.
RE40,399 E 6/2008 Hugenroth et al.
RE40,400 E 6/2008 Bass et al.
7,393,190 B2 7/2008 Lee et al.
7,404,706 B2 7/2008 Ishikawa et al.
RE40,554 E 10/2008 Bass et al.
7,510,382 B2 3/2009 Jeong
7,547,202 B2 6/2009 Knapke
7,695,257 B2 4/2010 Joo et al.
7,717,687 B2 5/2010 Reinhart
7,771,178 B2 8/2010 Perevozchikov et al.
7,802,972 B2 9/2010 Shimizu et al.
7,815,423 B2 10/2010 Guo et al.
7,891,961 B2 2/2011 Shimizu et al.
RE42,371 E 5/2011 Peyton
7,967,582 B2 6/2011 Akei et al.
7,967,583 B2 6/2011 Stover et al.
7,972,125 B2 7/2011 Stover et al.
7,976,289 B2 7/2011 Masao
7,976,295 B2 7/2011 Stover et al.
7,988,433 B2 8/2011 Akei et al.
8,025,492 B2 9/2011 Seibel et al.
8,303,278 B2 11/2012 Roof et al.
8,303,279 B2 11/2012 Hahn
8,308,448 B2 11/2012 Fields et al.
8,328,531 B2 12/2012 Milliff et al.
8,506,271 B2 8/2013 Seibel et al.
8,517,703 B2 8/2013 Doepker
8,585,382 B2 11/2013 Akei et al.
8,616,014 B2 12/2013 Stover et al.
8,790,098 B2 7/2014 Stover et al.
8,840,384 B2 9/2014 Patel et al.
8,857,200 B2 10/2014 Stover et al.

(56) References Cited

U.S. PATENT DOCUMENTS

| | | | |
|---|---|---|---|
| 8,932,036 | B2 | 1/2015 | Monnier et al. |
| 9,127,677 | B2 | 9/2015 | Doepker |
| 9,145,891 | B2 | 9/2015 | Kim et al. |
| 9,249,802 | B2 | 2/2016 | Doepker et al. |
| 9,303,642 | B2 | 4/2016 | Akei et al. |
| 9,435,340 | B2 | 9/2016 | Doepker et al. |
| 9,494,157 | B2 | 11/2016 | Doepker |
| 9,605,677 | B2 | 3/2017 | Heidecker et al. |
| 9,651,043 | B2 | 5/2017 | Stover et al. |
| 9,777,730 | B2 | 10/2017 | Doepker et al. |
| 9,790,940 | B2 | 10/2017 | Doepker et al. |
| 9,879,674 | B2 | 1/2018 | Akei et al. |
| 2001/0010800 | A1 | 8/2001 | Kohsokabe et al. |
| 2002/0039540 | A1 | 4/2002 | Kuroki et al. |
| 2003/0044296 | A1 | 3/2003 | Chen |
| 2003/0186060 | A1 | 10/2003 | Rao |
| 2003/0228235 | A1 | 12/2003 | Sowa et al. |
| 2004/0136854 | A1 | 7/2004 | Kimura et al. |
| 2004/0146419 | A1 | 7/2004 | Kawaguchi et al. |
| 2004/0184932 | A1 | 9/2004 | Lifson |
| 2004/0197204 | A1 | 10/2004 | Yamanouchi et al. |
| 2005/0019177 | A1 | 1/2005 | Shin et al. |
| 2005/0019178 | A1 | 1/2005 | Shin et al. |
| 2005/0053507 | A1 | 3/2005 | Takeuchi et al. |
| 2005/0069444 | A1 | 3/2005 | Peyton |
| 2005/0201883 | A1 | 9/2005 | Clendenin et al. |
| 2005/0214148 | A1 | 9/2005 | Ogawa et al. |
| 2006/0099098 | A1 | 5/2006 | Lee et al. |
| 2006/0198748 | A1 | 9/2006 | Grassbaugh et al. |
| 2006/0228243 | A1 | 10/2006 | Sun et al. |
| 2006/0233657 | A1 | 10/2006 | Bonear et al. |
| 2007/0036661 | A1 | 2/2007 | Stover |
| 2007/0110604 | A1 | 5/2007 | Peyton |
| 2007/0130973 | A1 | 6/2007 | Lifson et al. |
| 2008/0138227 | A1 | 6/2008 | Knapke |
| 2008/0159892 | A1 | 7/2008 | Huang et al. |
| 2008/0159893 | A1 | 7/2008 | Caillat |
| 2008/0196445 | A1 | 8/2008 | Lifson et al. |
| 2008/0223057 | A1 | 9/2008 | Lifson et al. |
| 2008/0305270 | A1 | 12/2008 | Uhlianuk et al. |
| 2009/0035167 | A1 | 2/2009 | Sun |
| 2009/0068048 | A1 | 3/2009 | Stover et al. |
| 2009/0071183 | A1 | 3/2009 | Stover et al. |
| 2009/0185935 | A1 | 7/2009 | Seibel et al. |
| 2009/0297377 | A1 | 12/2009 | Stover et al. |
| 2009/0297378 | A1 | 12/2009 | Stover et al. |
| 2009/0297379 | A1 | 12/2009 | Stover et al. |
| 2009/0297380 | A1 | 12/2009 | Stover et al. |
| 2010/0111741 | A1 | 5/2010 | Chikano et al. |
| 2010/0135836 | A1 | 6/2010 | Stover et al. |
| 2010/0158731 | A1 | 6/2010 | Akei et al. |
| 2010/0212311 | A1 | 8/2010 | McQuary et al. |
| 2010/0254841 | A1 | 10/2010 | Akei et al. |
| 2010/0300659 | A1 | 12/2010 | Stover et al. |
| 2010/0303659 | A1 | 12/2010 | Stover et al. |
| 2011/0135509 | A1 | 6/2011 | Fields et al. |
| 2011/0206548 | A1 | 8/2011 | Doepker |
| 2011/0293456 | A1 | 12/2011 | Seibel et al. |
| 2012/0107163 | A1 | 5/2012 | Monnier et al. |
| 2013/0078128 | A1 | 3/2013 | Akei |
| 2013/0089448 | A1 | 4/2013 | Ginies et al. |
| 2013/0121857 | A1 | 5/2013 | Liang et al. |
| 2013/0309118 | A1 | 11/2013 | Ginies et al. |
| 2013/0315768 | A1 | 11/2013 | Le Coat et al. |
| 2014/0023540 | A1 | 1/2014 | Heidecker et al. |
| 2014/0024563 | A1 | 1/2014 | Heidecker et al. |
| 2014/0037486 | A1 | 2/2014 | Stover et al. |
| 2014/0134030 | A1 | 5/2014 | Stover et al. |
| 2014/0134031 | A1 | 5/2014 | Doepker et al. |
| 2014/0147294 | A1 | 5/2014 | Fargo et al. |
| 2014/0154121 | A1 | 6/2014 | Doepker |
| 2014/0154124 | A1 | 6/2014 | Doepker et al. |
| 2015/0192121 | A1 | 7/2015 | Sung et al. |
| 2015/0330386 | A1 | 11/2015 | Doepker |
| 2015/0345493 | A1 | 12/2015 | Lochner et al. |
| 2015/0354719 | A1 | 12/2015 | van Beek et al. |
| 2016/0115954 | A1 | 4/2016 | Doepker et al. |
| 2016/0201673 | A1 | 7/2016 | Perevozchikov et al. |
| 2017/0002817 | A1 | 1/2017 | Stover |
| 2017/0002818 | A1 | 1/2017 | Stover |
| 2017/0268510 | A1 | 9/2017 | Stover et al. |
| 2017/0306960 | A1 | 10/2017 | Pax et al. |
| 2017/0314558 | A1 | 11/2017 | Pax et al. |
| 2018/0038369 | A1 | 2/2018 | Doepker et al. |
| 2018/0038370 | A1 | 2/2018 | Doepker et al. |
| 2018/0149155 | A1 | 5/2018 | Akei et al. |

FOREIGN PATENT DOCUMENTS

| | | | |
|---|---|---|---|
| CN | 1158945 | A | 9/1997 |
| CN | 1289011 | A | 3/2001 |
| CN | 1349053 | A | 5/2002 |
| CN | 1382912 | A | 12/2002 |
| CN | 1517553 | A | 8/2004 |
| CN | 1680720 | A | 10/2005 |
| CN | 1702328 | A | 11/2005 |
| CN | 2747381 | Y | 12/2005 |
| CN | 1828022 | A | 9/2006 |
| CN | 1963214 | A | 5/2007 |
| CN | 1995756 | A | 7/2007 |
| CN | 101358592 | A | 2/2009 |
| CN | 101761479 | A | 6/2010 |
| CN | 101806302 | A | 8/2010 |
| CN | 101910637 | A | 12/2010 |
| CN | 102076963 | A | 5/2011 |
| CN | 102089525 | A | 6/2011 |
| CN | 102272454 | A | 12/2011 |
| CN | 102422024 | A | 4/2012 |
| CN | 102449314 | A | 5/2012 |
| CN | 102762866 | A | 10/2012 |
| CN | 202926640 | U | 5/2013 |
| CN | 103502644 | A | 1/2014 |
| CN | 103671125 | A | 3/2014 |
| CN | 204041454 | U | 12/2014 |
| CN | 104838143 | A | 8/2015 |
| CN | 205533207 | U | 8/2016 |
| CN | 205876712 | U | 1/2017 |
| CN | 205876713 | U | 1/2017 |
| CN | 205895597 | U | 1/2017 |
| EP | 0822335 | A2 | 2/1998 |
| EP | 1067289 | A2 | 1/2001 |
| EP | 1087142 | A2 | 3/2001 |
| EP | 1182353 | A1 | 2/2002 |
| EP | 1241417 | A1 | 9/2002 |
| EP | 1371851 | A2 | 12/2003 |
| EP | 1382854 | A2 | 1/2004 |
| EP | 2151577 | A1 | 2/2010 |
| GB | 2107829 | A | 5/1983 |
| JP | 60259794 | | 12/1985 |
| JP | S6385277 | A | 4/1988 |
| JP | 63-205482 | | 8/1988 |
| JP | H0281982 | A | 3/1990 |
| JP | 03081588 | A | 4/1991 |
| JP | H04272490 | A | 9/1992 |
| JP | H07-293456 | A | 11/1995 |
| JP | H08247053 | A | 9/1996 |
| JP | 08334094 | A | 12/1996 |
| JP | H8320079 | A | 12/1996 |
| JP | H09-177689 | A | 7/1997 |
| JP | 11107950 | | 4/1999 |
| JP | H11324950 | A | 11/1999 |
| JP | 2000104684 | A | 4/2000 |
| JP | 2000161263 | A | 6/2000 |
| JP | 2000329078 | A | 11/2000 |
| JP | 2003074481 | A | 3/2003 |
| JP | 2003074482 | A | 3/2003 |
| JP | 2003106258 | A | 4/2003 |
| JP | 2003227479 | A | 8/2003 |
| JP | 2007154761 | A | 6/2007 |
| JP | 2008248775 | A | 10/2008 |
| JP | 2013167215 | A | 8/2013 |
| KR | 1019870000015 | | 5/1985 |
| KR | 870000015 | B1 | 1/1987 |
| KR | 20050027402 | A | 3/2005 |

(56) References Cited

FOREIGN PATENT DOCUMENTS

| | | | |
|---|---|---|---|
| KR | 20050095246 | A | 9/2005 |
| KR | 100547323 | B1 | 1/2006 |
| KR | 20100017008 | A | 2/2010 |
| KR | 101192642 | B1 | 10/2012 |
| KR | 20120115581 | A | 10/2012 |
| WO | WO-0073659 | A1 | 12/2000 |
| WO | WO-2007046810 | A2 | 4/2007 |
| WO | WO-2009017741 | A1 | 2/2009 |
| WO | WO-2009155099 | A2 | 12/2009 |
| WO | WO-2010118140 | A2 | 10/2010 |
| WO | WO-2011106422 | A2 | 9/2011 |
| WO | WO-2012114455 | A1 | 8/2012 |

OTHER PUBLICATIONS

Extended European Search Report regarding Application No. EP07254962 dated Mar. 12, 2008.
U.S. Office Action regarding U.S. Appl. No. 11/645,288 dated Nov. 30, 2009.
First China Office Action regarding Application No. 200710160038.5 dated Jul. 8, 2010. Translation provided by Unitalen Attorneys At Law.
International Search Report regarding Application No. PCT/US2010/030248, dated Nov. 26, 2010.
Written Opinion of the International Searching Authority regarding Application No. PCT/US2010/030248, dated Nov. 26, 2010.
International Search Report regarding Application No. PCT/US2011/025921, dated Oct. 7, 2011.
Written Opinion of the International Search Authority regarding Application No. PCT/US2011/025921, dated Oct. 7, 2011.
China Office Action regarding Application No. 200710160038.5 dated Jan. 31, 2012. Translation provided by Unitalen Attorneys At Law.
U.S. Office Action regarding U.S. Appl. No. 13/181,065 dated Nov. 9, 2012.
International Search Report regarding Application No. PCT/US2013/051678, dated Oct. 21, 2013.
Written Opinion of the International Searching Authority regarding Application No. PCT/US2013/051678, dated Oct. 21, 2013.
China Office Action regarding Application No. 201080020243.1 dated Nov. 5, 2013. Translation provided by Unitalen Attorneys At Law.
International Search Report regarding Application No. PCT/US2013/069456, dated Feb. 18, 2014.
Written Opinion of the International Searching Authority regarding Application No. PCT/US2013/069456, dated Feb. 18, 2014.
International Search Report regarding Application No. PCT/US2013/069462, dated Feb. 21, 2014.
Written Opinion of the International Searching Authority regarding Application No. PCT/US2013/069462, dated Feb. 21, 2014.
International Search Report regarding Application No. PCT/US2013/070992, dated Feb. 25, 2014.
Written Opinion of the International Searching Authority regarding Application No. PCT/US2013/070992, dated Feb. 25, 2014.
International Search Report regarding Application No. PCT/US2013/070981, dated Mar. 4, 2014.
Written Opinion of the International Searching Authority regarding Application No. PCT/US2013/070981, dated Mar. 4, 2014.
Second Office Action regarding China Application No. 201180010366.1 dated Dec. 31, 2014. Translation provided by Unitalen Attorneys At Law.
Office Action regarding U.S. Appl. No. 14/081,390, dated Mar. 27, 2015.
Search Report regarding European Patent Application No. 10762374.6-1608 / 2417356 PCT/US2010030248, dated Jun. 16, 2015.
Office Action regarding U.S. Appl. No. 14/060,240, dated Aug. 12, 2015.
International Search Report regarding International Application No. PCT/US2015/033960, dated Sep. 1, 2015.
Written Opinion of the International Searching Authority regarding International Application No. PCT/US2015/033960, dated Sep. 1, 2015.
Office Action regarding U.S. Appl. No. 14/073,293, dated Sep. 25, 2015.
Restriction Requirement regarding U.S. Appl. No. 14/060,102, dated Oct. 7, 2015.
Office Action regarding Chinese Patent Application No. 201410461048.2, dated Nov. 30, 2015. Translation provided by Unitalen Attorneys at Law.
Interview Summary regarding U.S. Appl. No. 14/060,240, dated Dec. 1, 2015.
Office Action regarding U.S. Appl. No. 14/073,293, dated Jan. 29, 2016.
Office Action regarding Chinese Patent Application No. 201410460792.0, dated Feb. 25, 2016. Translation provided by Unitalen Attorneys at Law.
Restriction Requirement regarding U.S. Appl. No. 14/060,102, dated Mar. 16, 2016.
First Office Action regarding Chinese Application No. 201380059666.8, dated Apr. 5, 2016. Translation provided by Unitalen Attorneys At Law.
First Office Action regarding Chinese Application No. 201380062614.6, dated Apr. 5, 2016. Translation provided by Unitalen Attorneys At Law.
Advisory Action regarding U.S. Appl. No. 14/073,293, dated Apr. 18, 2016.
Office Action regarding Chinese Patent Application No. 201380062657.4, dated May 4, 2016. Translation provided by Unitalen Attorneys at Law.
Office Action regarding Chinese Patent Application No. 201380059963.2, dated May 10, 2016. Translation provided by Unitalent Attorneys at Law.
Office Action regarding U.S. Appl. No. 14/060,102, dated Jun. 14, 2016.
Office Action regarding U.S. Appl. No. 14/846,877, dated Jul. 15, 2016.
Office Action regarding Chinese Patent Application No. 201410461048.2, dated Jul. 26, 2016. Translation provided by Unitalen Attorneys at Law.
Search Report regarding European Patent Application No. 13858194.7, dated Aug. 3, 2016.
Search Report regarding European Patent Application No. 13859308.2, dated Aug. 3, 2016.
Office Action regarding U.S. Appl. No. 14/294,458, dated Aug. 19, 2016.
Office Action regarding Chinese Patent Application No. 201410460792.0, dated Oct. 21, 2016. Translation provided by Unitalen Attorneys At Law.
Search Report regarding European Patent Application No. 11747996.4, dated Nov. 7, 2016.
Office Action regarding Chinese Patent Application No. 201380059666.8, dated Nov. 23, 2016. Translation provided by Unitalen Attorneys at Law.
Office Action regarding U.S. Appl. No. 14/060,102, dated Dec. 28, 2016.
International Search Report regarding International Application No. PCT/CN2016/103763, dated Jan. 25, 2017.
Written Opinion of the International Searching Authority regarding International Application No. PCT/CN2016/103763, dated Jan. 25, 2017.
Office Action regarding U.S. Appl. No. 15/156,400, dated Feb. 23, 2017.
Office Action regarding U.S. Appl. No. 14/294,458, dated Feb. 28, 2017.
Advisory Action regarding U.S. Appl. No. 14/060,102, dated Mar. 3, 2017.
Office Action regarding U.S. Appl. No. 14/663,073, dated Apr. 11, 2017.
Office Action regarding Chinese Patent Application No. 201410460792.0, dated Apr. 24, 2017.
Translation provided by Unitalen Attorneys at Law.

(56) References Cited

OTHER PUBLICATIONS

Office Action regarding U.S. Appl. No. 14/946,824, dated May 10, 2017.
Advisory Action regarding U.S. Appl. No. 14/294,458, dated Jun. 9, 2017.
Office Action regarding Chinese Patent Application No. 201610703191.7, dated Jun. 13, 2017. Translation provided by Unitalen Attorneys at Law.
Office Action regarding Indian Patent Application No. 2043/MUMNP/2011, dated Jul. 28, 2017.
Office Action regarding U.S. Appl. No. 14/294,458, dated Sep. 21, 2017.
Office Action regarding U.S. Appl. No. 14/757,407, dated Oct. 13, 2017.
Office Action regarding Chinese Patent Application No. 201610158216.X, dated Oct. 30, 2017. Translation provided by Unitalen Attorneys at Law.
Office Action regarding Chinese Patent Application No. 201410460792.0, dated Nov. 1, 2017. Translation provided by Unitalen Attorneys At Law.
Office Action regarding Chinese Patent Application No. 201610512702.7, dated Dec. 20, 2017. Partial translation provided by Unitalen Attorneys at Law.
Office Action regarding Chinese Patent Application No. 201610499158.7, dated Jan. 9, 2018. Translation provided by Unitalen Attorneys at Law.
Office Action regarding Chinese Patent Application No. 201580029636.1, dated Jan. 17, 2018. Translation provided by Unitalen Attorneys at Law.
Office Action regarding U.S. Appl. No. 15/646,654, dated Feb. 9, 2018.
Office Action regarding U.S. Appl. No. 15/651,471 dated Feb. 23, 2018.
Office Action regarding Indian Patent Application No. 1907/MUMNP/2012, dated Feb. 26, 2018.
Office Action regarding Korean Patent Application No. 10-2016-7034539, dated Apr. 11, 2018. Translation provided by Y.S. Chang & Associates.
Office Action regarding Chinese Patent Application No. 201610930347.5, dated May 14, 2018. Translation provided by Unitalen Attorneys at Law.
Notice of Allowance regarding U.S. Appl. No. 14/757,407, dated May 24, 2018.
Office Action regarding Chinese Patent Application No. 201610158216.X, dated Jun. 13, 2018. Translation provided by Unitalen Attorneys at Law.
Office Action regarding European Patent Application No. 13859308.2, dated Jun. 22, 2018.
Office Action regarding U.S. Appl. No. 15/186,092, dated Jun. 29, 2018.
Notice of Allowance regarding U.S. Appl. No. 15/646,654, dated Jul. 11, 2018.
Notice of Allowance regarding U.S. Appl. No. 15/651,471, dated Jul. 11, 2018.
Office Action regarding U.S. Appl. No. 15/784,540, dated Jul. 17, 2018.
Office Action regarding U.S. Appl. No. 15/784,458, dated Jul. 19, 2018.
Election/Restriction Requirement regarding U.S. Appl. No. 15/587,735, dated Jul. 23, 2018.
Election Requirement regarding U.S. Appl. No. 15/186,092, dated Apr. 3, 2018.
Election Requirement regarding U.S. Appl. No. 15/784,458, dated Apr. 5, 2018.
Non-Final Office Action regarding U.S. Appl. No. 15/186,151, dated May 3, 2018.
Office Action regarding Chinese Patent Application No. 201610516097.0, dated Jun. 27, 2017. Translation provided by Unitalen Attorneys at Law.

* cited by examiner

COMPRESSOR WITH THERMALLY-RESPONSIVE MODULATION SYSTEM

CROSS-REFERENCE TO RELATED APPLICATIONS

This application claims the benefit of U.S. Provisional Application No. 62/198,399, filed on Jul. 29, 2015, and U.S. Provisional Application No. 62/187,350, filed on Jul. 1, 2015. The entire disclosures of each of the above applications are incorporated herein by reference.

FIELD

The present disclosure relates to a compressor, and more specifically to a compressor having a thermally responsive modulation system.

BACKGROUND

This section provides background information related to the present disclosure and is not necessarily prior art.

Cooling systems, refrigeration systems, heat-pump systems, and other climate-control systems include a fluid circuit having a condenser, an evaporator, an expansion device disposed between the condenser and evaporator, and a compressor circulating a working fluid (e.g., refrigerant) between the condenser and the evaporator. Efficient and reliable operation of the compressor is desirable to ensure that the cooling, refrigeration, or heat-pump system in which the compressor is installed is capable of effectively and efficiently providing a cooling and/or heating effect on demand.

SUMMARY

This section provides a general summary of the disclosure, and is not a comprehensive disclosure of its full scope or all of its features.

According to one aspect, the present disclosure provides a compressor that may include a first scroll, a second scroll and a modulation system. The first scroll may include a first endplate and a first spiral wrap. The second scroll may include a second endplate and a second spiral wrap interleaved with the first spiral wrap and cooperating to form a plurality of working fluid pockets therebetween. The modulation system may include a temperature-responsive displacement member that actuates or expands in response to a temperature within a space rising above a predetermined threshold. Actuation of the displacement member moves one of the first and second scrolls axially relative to the other of the first and second scrolls.

In some configurations, the modulation system includes a displacement member control module to control the displacement member based on an operating temperature of the compressor. The displacement member control module may utilize pulse-width-modulation to cycle between "on" and "off" states to allow the modulation system to cycle between a full-load operating condition and a no-load operating condition in order to control the operating capacity of the compressor.

In some configurations, the displacement member includes a shape-memory material.

In some configurations, the shape memory material includes at least one of a bi-metal and tri-metal shape memory alloy.

In some configurations, the displacement member is an annular member that encircles a rotational axis of a drive shaft of the compressor.

In some configurations, the compressor includes a seal assembly and a biasing member. The seal assembly may be disposed within an annular recess of the first scroll. The biasing member may be disposed between the seal assembly and the first endplate and may bias the seal assembly into sealing engagement with a partition separating a discharge chamber from a suction chamber. The biasing member may bias the first scroll axially toward the second scroll.

In some configurations, the first endplate is disposed axially between the displacement member and the second endplate.

In some configurations, the displacement member is disposed within a discharge chamber that receives discharge-pressure working fluid.

In some configurations, the modulation system includes a hub engaging the first scroll and extending into the discharge chamber through an opening in a partition that separates the discharge chamber from a suction chamber.

In some configurations, the displacement member encircles said hub and is disposed axially between the partition and a flange of the hub.

In some configurations, the compressor includes a bearing housing rotatably supporting a drive shaft driving said second scroll. The displacement member may engage the bearing housing and the first scroll.

In some configurations, the displacement member encircles said second endplate.

In some configurations, the modulation system includes a control module in communication with the displacement member and a temperature sensor. The temperature sensor may be disposed within a discharge chamber of the compressor. Alternatively, the temperature sensor may be disposed within a suction chamber of the compressor. Alternatively, the temperature sensor may be disposed outside of the compressor (e.g., in a space to be conditioned).

According to another aspect, the present disclosure provides a compressor that may include first and second scrolls and a modulation system. The first scroll may include a first endplate and a first spiral wrap. The second scroll may include a second endplate and a second spiral wrap interleaved with the first spiral wrap and cooperating to form a plurality of working fluid pockets therebetween. The first endplate may include a first passage and a second passage. The first passage may be in communication with an intermediate one of the working fluid pockets. The modulation system may include a modulation member and a temperature-responsive displacement member. The modulation member may engage the first endplate and may be movable relative to the first endplate between a first position in which the modulation member blocks communication between the first and second passages and a second position in which the modulation member is spaced apart from the first passage to allow communication between the first and second passages. The displacement member may engage the modulation member and may actuate or expand and contract to axially move the modulation member between the first and second positions.

In some configurations, the modulation member is an annular hub that at least partially defines a discharge passage through which discharge-pressure working fluid enters a discharge chamber of the compressor.

In some configurations, the modulation member includes a base portion having an annular protrusion (or a series of individual protrusions) extending axially therefrom. The protrusion may seal the first passage when the modulation member is in the first position.

In some configurations, the first passage extends axially through said first endplate. The second passage may extend radially through the first endplate.

In some configurations, the compressor includes a seal assembly and a biasing member. The seal assembly may be disposed within an annular recess of the first scroll. The biasing member may be disposed between the seal assembly and the first endplate and may bias the seal assembly into sealing engagement with a partition separating a discharge chamber from a suction chamber. The biasing member may bias the first scroll axially toward the second scroll.

In some configurations, the displacement member is disposed between and engages the modulation member and an axially facing surface of the first endplate.

In some configurations, the displacement member is disposed between and engages the modulation member and a partition separating a discharge chamber from a suction chamber.

In some configurations, the displacement member is disposed within the discharge chamber.

In some configurations, the modulation system includes a control module in communication with the displacement member and a temperature sensor. The temperature sensor may be disposed within a discharge chamber of the compressor. Alternatively, the temperature sensor may be disposed within a suction chamber of the compressor. Alternatively, the temperature sensor may be disposed outside of the compressor.

In some configurations, the displacement member includes a shape memory material.

In some configurations, the shape memory material includes at least one of a bi-metal and tri-metal shape memory alloy.

According to another aspect, the present disclosure provides a compressor that may include a housing, a partition, a first scroll, a second scroll, and a modulation system. The partition may define a suction chamber and a discharge chamber, and may include a discharge passage in fluid communication with the discharge chamber. The first and second scrolls may be supported within the housing and form a series of compression pockets. The second scroll may include a second endplate having an annular recess, a first modulation passage, and a second modulation passage. The first modulation passage may be in fluid communication with the suction chamber and the annular recess. The second modulation passage may be in fluid communication with at least one of the compression pockets and the annular recess. The modulation system may include a hub and a displacement member. The hub may be translatably disposed within the annular recess and the discharge passage. The displacement member may be disposed between the hub and the partition and may be configured to translate the hub relative to the second scroll between first and second positions.

In some configurations, the displacement member comprises a shape memory material.

In some configurations, the shape memory material includes at least one of a bi-metal and tri-metal shape memory alloy.

In some configurations, the displacement member is configured to translate the hub in response to a change in temperature of the displacement member.

In some configurations, the compressor includes a seal assembly and a biasing member. The seal assembly may be disposed within the annular recess. The biasing member may be disposed between the seal assembly and the hub and configured to bias the seal assembly into sealing engagement with the partition.

In some configurations, the compressor may include a seal assembly disposed within the annular recess. The second endplate may further comprise a first communication passage in fluid communication with the annular recess and at least one of the compression pockets. The first communication passage may be configured to bias the seal assembly into sealing engagement with the partition.

In some configurations, the hub includes an axially extending flange configured to inhibit fluid communication between the suction chamber and at least one of the compression pockets in the first position.

In some configurations, the modulation system further includes a displacement member control module operable to change a temperature of the displacement member in response to an operating temperature of the compressor.

In some configurations, the compressor includes a temperature sensor that senses the operating temperature of the compressor.

In some configurations, the temperature sensor is disposed within the discharge chamber.

According to another aspect, the present disclosure provides a compressor. The compressor may include a housing, a partition, a first scroll, a second scroll, and a modulation system. The housing may include a suction chamber and a discharge chamber. The partition may be disposed within the housing, and may include a discharge passage in fluid communication with the discharge chamber. The first scroll may be supported within the housing and may include a first endplate having a first spiral wrap. The second scroll may be supported within the housing and may include a second spiral wrap extending from a second endplate. The second spiral wrap may be meshingly engaged with the first spiral wrap to form a series of compression pockets. The second endplate may include an annular recess and a modulation passage. The annular recess may be in fluid communication with at least one of the compression pockets. The modulation passage may be in fluid communication with the suction chamber and the annular recess. The modulation system may include a hub and a displacement member. The hub may be disposed within the annular recess and the discharge passage. The displacement member may be configured to translate the hub relative to the second scroll in response to a change in temperature of the displacement member in order to selectively allow fluid communication between the modulation passage and at least one of the compression pockets.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 6A:
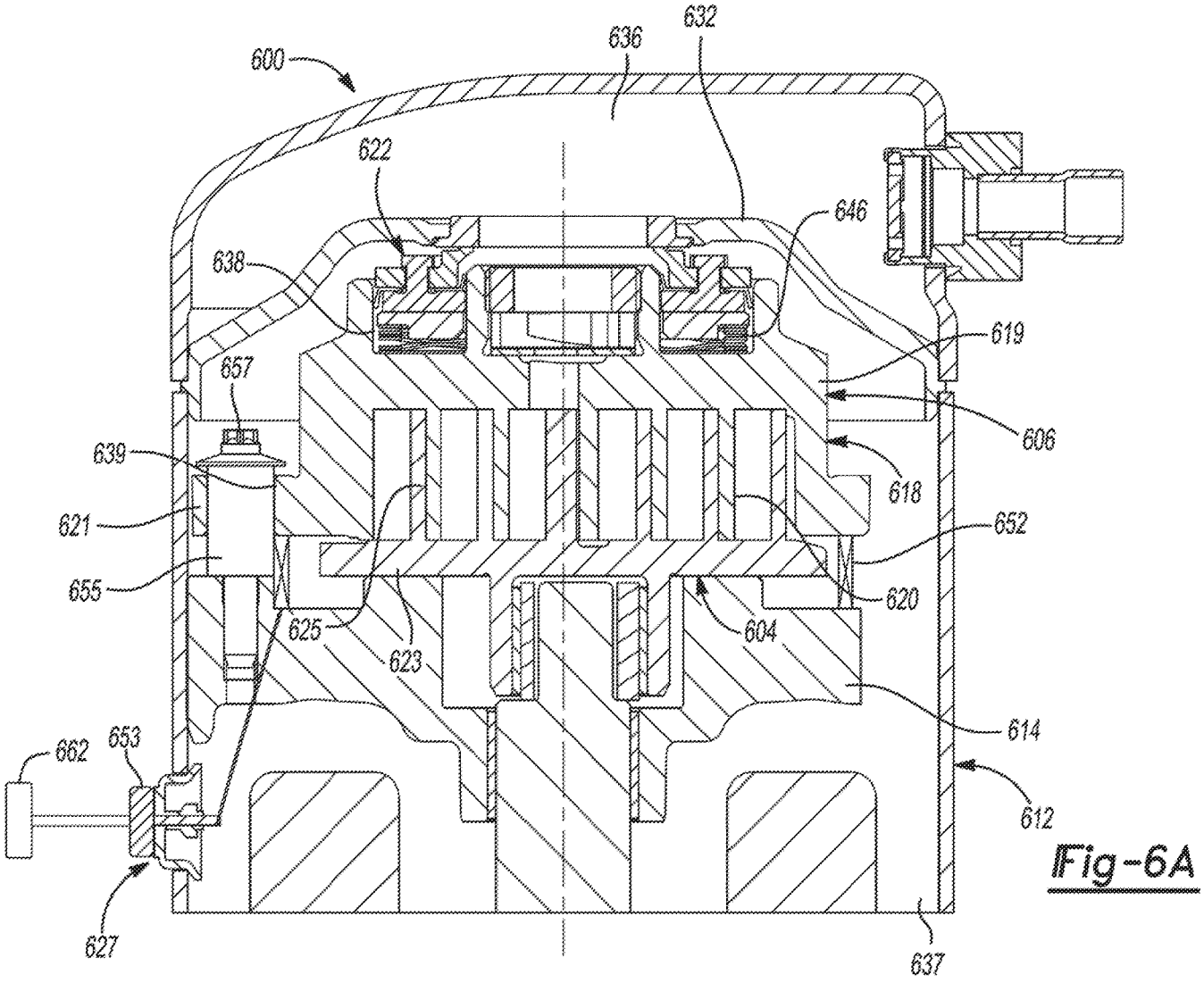
Figure 6B:
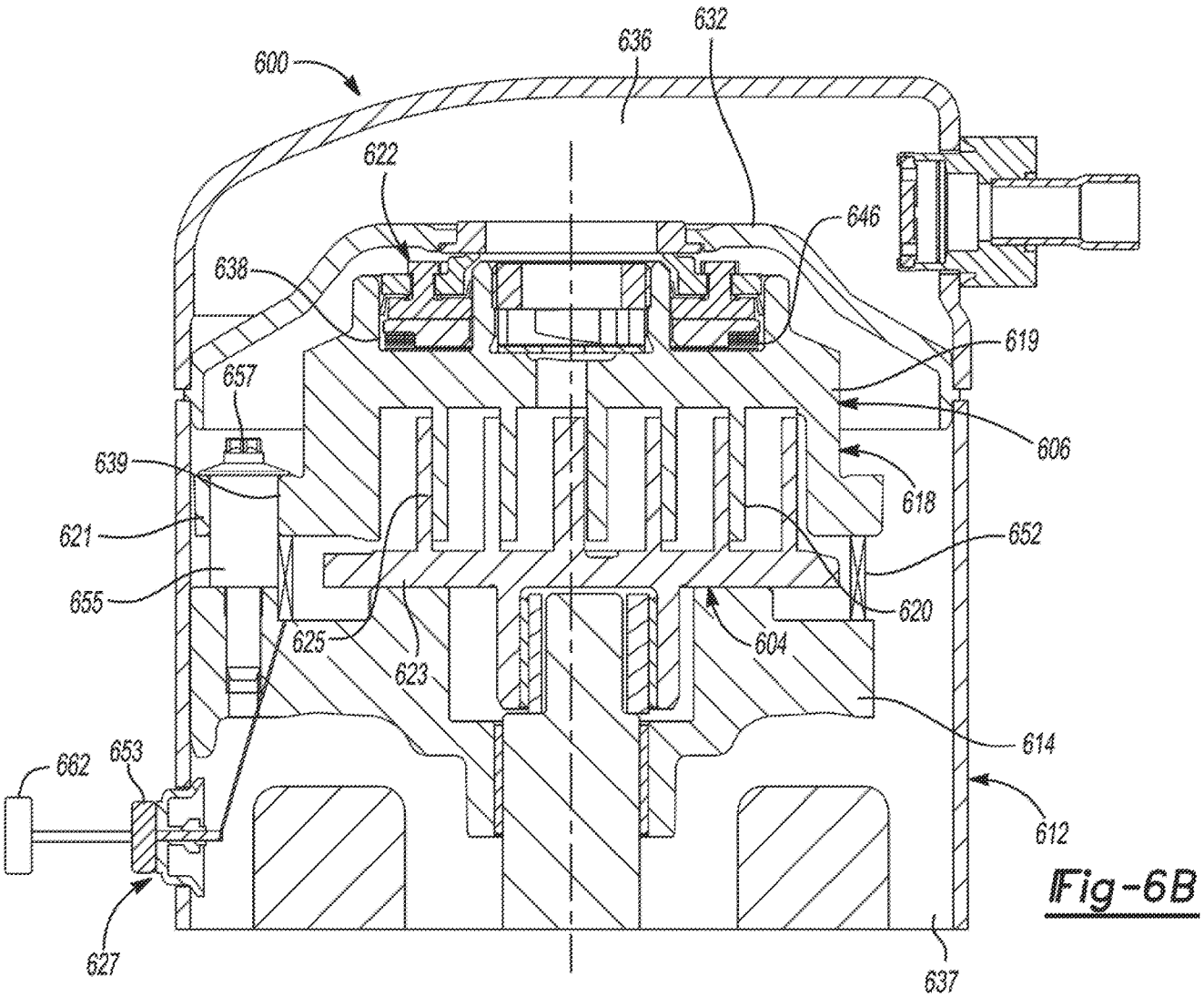

FIG. 6A is a partial cross-sectional view of another compressor incorporating another modulation system constructed in accordance with the principles of the present disclosure, the modulation system shown in a deactivated position causing the compressor to operate in a full load operating condition; and FIG. 6B is a partial cross-sectional view of the compressor of FIG. 6A, the modulation system shown in an activated position causing the compressor to operate in a no load operating condition.

Corresponding reference numerals indicate corresponding parts throughout the several views of the drawings.

DETAILED DESCRIPTION

The following description is merely exemplary in nature and is not intended to limit the present disclosure, application or uses. It should be understood that throughout the drawings, corresponding reference numerals indicate like or corresponding parts and features.

The present teachings are suitable for incorporation in many types of different scroll and rotary compressors, including hermetic machines, open drive machines and non-hermetic machines. For exemplary purposes, a compressor 10 is shown as a hermetic scroll refrigerant-compressor of the low side type, i.e., where the motor and compressor are cooled by suction gas in the hermetic shell, as illustrated in the vertical section shown in FIG. 1.

Figure 1:
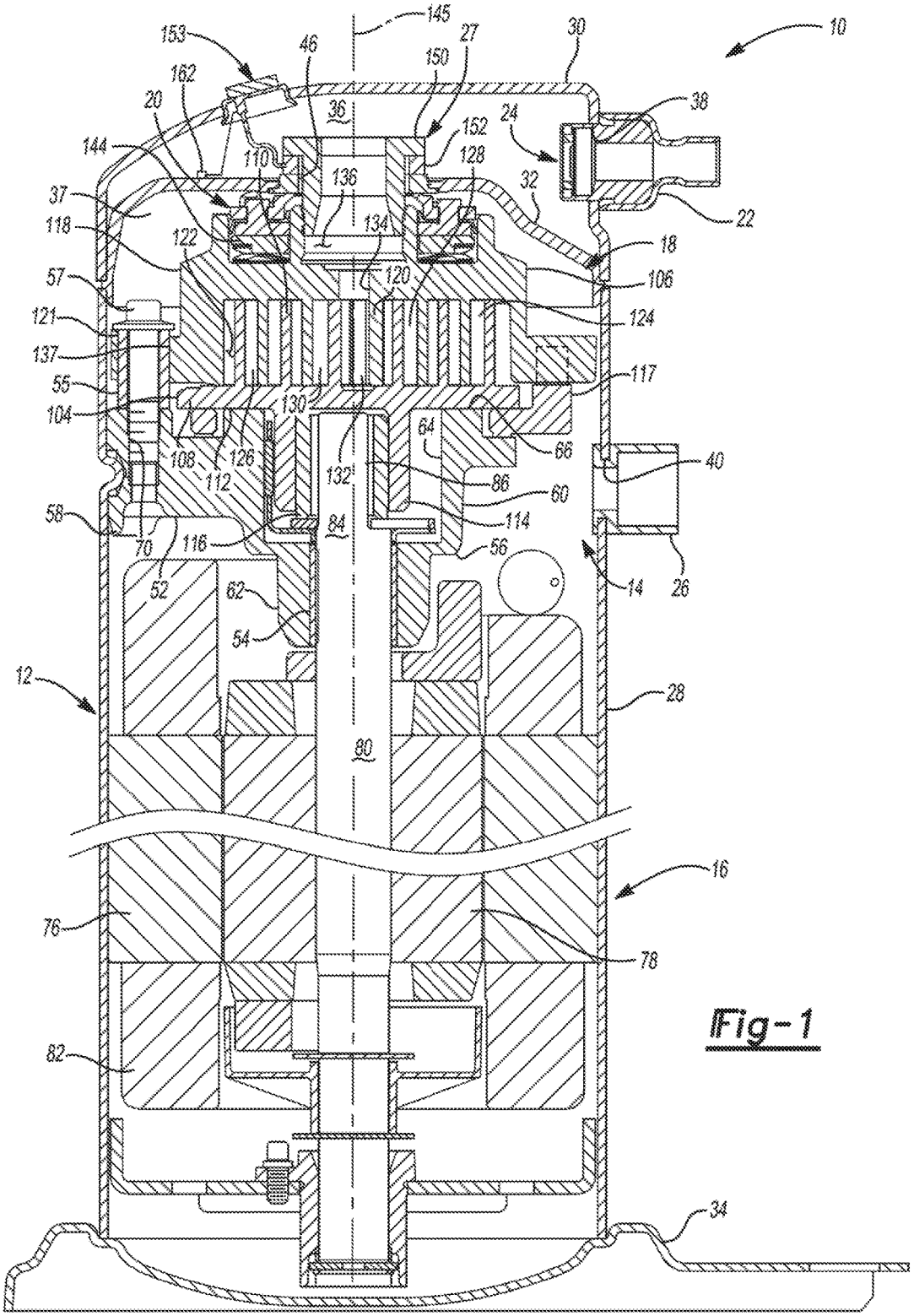
FIG. 1 is a cross-sectional view of a compressor incorporating a modulation system constructed in accordance with the principles of the present disclosure.

With initial reference to FIG. 1, the compressor 10 may include a hermetic shell assembly 12, a main bearing housing assembly 14, a motor assembly 16, a compression mechanism 18, a seal assembly 20, a refrigerant discharge fitting 22, a discharge valve assembly 24, a suction gas inlet fitting 26, and a capacity modulation system 27. The shell assembly 12 may house the main bearing housing assembly 14, the motor assembly 16, and the compression mechanism 18.

The shell assembly 12 may generally form a compressor housing and may include a cylindrical shell 28, an end cap 30 at the upper end thereof, a transversely extending partition 32, and a base 34 at a lower end thereof. The end cap 30 and the partition 32 may generally define a discharge chamber 36, while the cylindrical shell 28, the partition 32, and the base 34 may generally define a suction chamber 37. The discharge chamber 36 may generally form a discharge muffler for the compressor 10. The refrigerant discharge fitting 22 may be attached to the shell assembly 12 at the opening 38 in the end cap 30. The discharge valve assembly 24 may be located within the discharge fitting 22 and may generally prevent a reverse flow condition. The suction gas inlet fitting 26 may be attached to the shell assembly 12 at the opening 40, such that the suction gas inlet fitting 26 is in fluid communication with the suction chamber 37. The partition 32 may include a discharge passage 46 therethrough that provides communication between the compression mechanism 18 and the discharge chamber 36.

The main bearing housing assembly 14 may be affixed to the shell 28 at a plurality of points in any desirable manner, such as staking. The main bearing housing assembly 14 may include a main bearing housing 52, a first bearing 54 disposed therein, bushings 55, and fasteners 57. The main bearing housing 52 may include a central body portion 56 having a series of arms 58 that extend radially outwardly therefrom. The central body portion 56 may include first and second portions 60 and 62 having an opening 64 extending therethrough. The second portion 62 may house the first bearing 54 therein. The first portion 60 may define an annular flat thrust bearing surface 66 on an axial end surface thereof. The arm 58 may include apertures 70 extending therethrough that receive the fasteners 57.

The motor assembly 16 may generally include a motor stator 76, a rotor 78, and a drive shaft 80. Windings 82 may pass through the motor stator 76. The motor stator 76 may be press-fit into the shell 28. The drive shaft 80 may be rotatably driven by the rotor 78. The rotor 78 may be press-fit on the drive shaft 80. The drive shaft 80 may include an eccentric crank pin 84 having a flat 86 thereon.

The compression mechanism 18 may generally include an orbiting scroll 104 and a non-orbiting scroll 106. The orbiting scroll 104 may include an endplate 108 having a spiral vane or wrap 110 on the upper surface thereof and an annular flat thrust surface 112 on the lower surface. The thrust surface 112 may interface with the annular flat thrust bearing surface 66 on the main bearing housing 52. A cylindrical hub 114 may project downwardly from the thrust surface 112 and may have a drive bushing 116 rotatably disposed therein. The drive bushing 116 may include an inner bore in which the crank pin 84 is drivingly disposed. The crank pin flat 86 may drivingly engage a flat surface in a portion of the inner bore of the drive bushing 116 to provide a radially compliant driving arrangement. An Oldham coupling 117 may be engaged with the orbiting and non-orbiting scrolls 104, 106 to prevent relative rotation therebetween.

The non-orbiting scroll 106 may include an endplate 118 having a spiral wrap 120 on a lower surface thereof and a series of radially outwardly extending flanged portions 121. The spiral wrap 120 may form a meshing engagement with the wrap 110 of the orbiting scroll 104, thereby creating an inlet pocket 122, intermediate pockets 124, 126, 128, 130, and an outlet pocket 132. The non-orbiting scroll 106 may be axially displaceable relative to the main bearing housing assembly 14, the shell assembly 12, and the orbiting scroll 104. The non-orbiting scroll 106 may include a discharge passage 134 in communication with the outlet pocket 132 and an upwardly open recess 136. The upwardly open recess 136 may be in fluid communication with the discharge chamber 36 via the discharge passage 46 in the partition 32.

The flanged portions 121 may include openings 137 therethrough. Each opening 137 may receive a bushing 55 therein. The respective bushings 55 may receive fasteners 57. The fasteners 57 may be engaged with the main bearing housing 52 and the bushings 55 may generally form a guide for axial displacement of the non-orbiting scroll 106 (i.e., displacement in a direction along or parallel to an axis of rotation of the drive shaft 80). The fasteners 57 may additionally prevent rotation of the non-orbiting scroll 106 relative to the main bearing housing assembly 14. The non-orbiting scroll 106 may include an annular recess 138 in the upper surface thereof defined by parallel and coaxial inner and outer sidewalls 140, 142.

The seal assembly 20 may include a floating seal 144 located within the annular recess 138. The seal assembly 20 may be axially displaceable relative to the shell assembly 12 and/or the non-orbiting scroll 106 to provide for axial displacement (i.e., displacement parallel to an axis of rotation 145) of the non-orbiting scroll 106 while maintaining a sealed engagement with the partition 32 to isolate discharge and suction pressure regions of the compressor 10 from one another. More specifically, in some configurations, pressure, and/or a biasing member (e.g., annular wave spring) 146, within the annular recess 138 may urge the seal assembly 20 into engagement with the partition 32, and the spiral wrap 120 of the non-orbiting scroll 106 into engagement with the endplate 108 of the orbiting scroll 104, during normal compressor operation.

The modulation system 27 may include a hub 150 (e.g., a modulation member), an actuator or displacement member 152, and a displacement member control module 153. The hub 150 may include an axially extending portion 154 and a radially outwardly extending flange 156. The hub 150 may be partially disposed within the discharge passage 46 of the partition 32, and may be coupled to the non-orbiting scroll 106. For example, in some configurations, the hub 150 may be disposed within the recess 136 of the non-orbiting scroll 106, and may be coupled to the non-orbiting scroll 106 through a press-fit or threaded engagement within the recess 136. Accordingly, the hub 150 may be axially displaceable with the non-orbiting scroll 106 relative to the shell assembly 12, the seal assembly 20, and the partition 32.

The displacement member 152 may be disposed radially outwardly of the hub 150. In some configurations, the displacement member 152 may include a ring-shaped construct disposed annularly about the axially extending portion 154 of the hub 150. In an assembled configuration, the displacement member 152 may be disposed axially between the flange 156 and the partition 32, and the flange 156 is disposed axially between the partition 32 and the end cap 30. Accordingly, as will be explained in more detail below, the displacement member 152 can axially displace the hub 150 and the non-orbiting scroll 106 relative to the shell assembly 12 and the partition 32. In particular, the displacement member 152 may apply equal and opposite axially-extending forces on a lower surface 158 of the flange 156 and an upper surface 159 of the partition 32 in order to axially displace the hub 150 and the non-orbiting scroll 106 relative to the shell assembly 12 and the partition 32.

In some configurations, the displacement member 152 may include a material having shape-memory characteristics. In this regard, the displacement member 152 may be formed from a thermally-responsive material that changes shape, or otherwise activates, in response to a change in temperature. In particular, the displacement member 152 may be formed from a material that is thermally responsive at a predetermined threshold temperature. The predetermined threshold temperature may be between 30 degrees Celsius and 150 degrees Celsius. In some configurations, the displacement member 152 may be formed from a material that is thermally responsive at a predetermined threshold temperature of approximately 200 degrees Celsius. For example, in some configurations, the displacement member 152 may be formed from a bi- or tri-metal shape memory alloy such as a copper-zinc-aluminum alloy, a copper-aluminum-nickel alloy, an iron-manganese-silicon alloy, a nickel-aluminum alloy, or a nickel-titanium (nitinol).

Figure 2A:
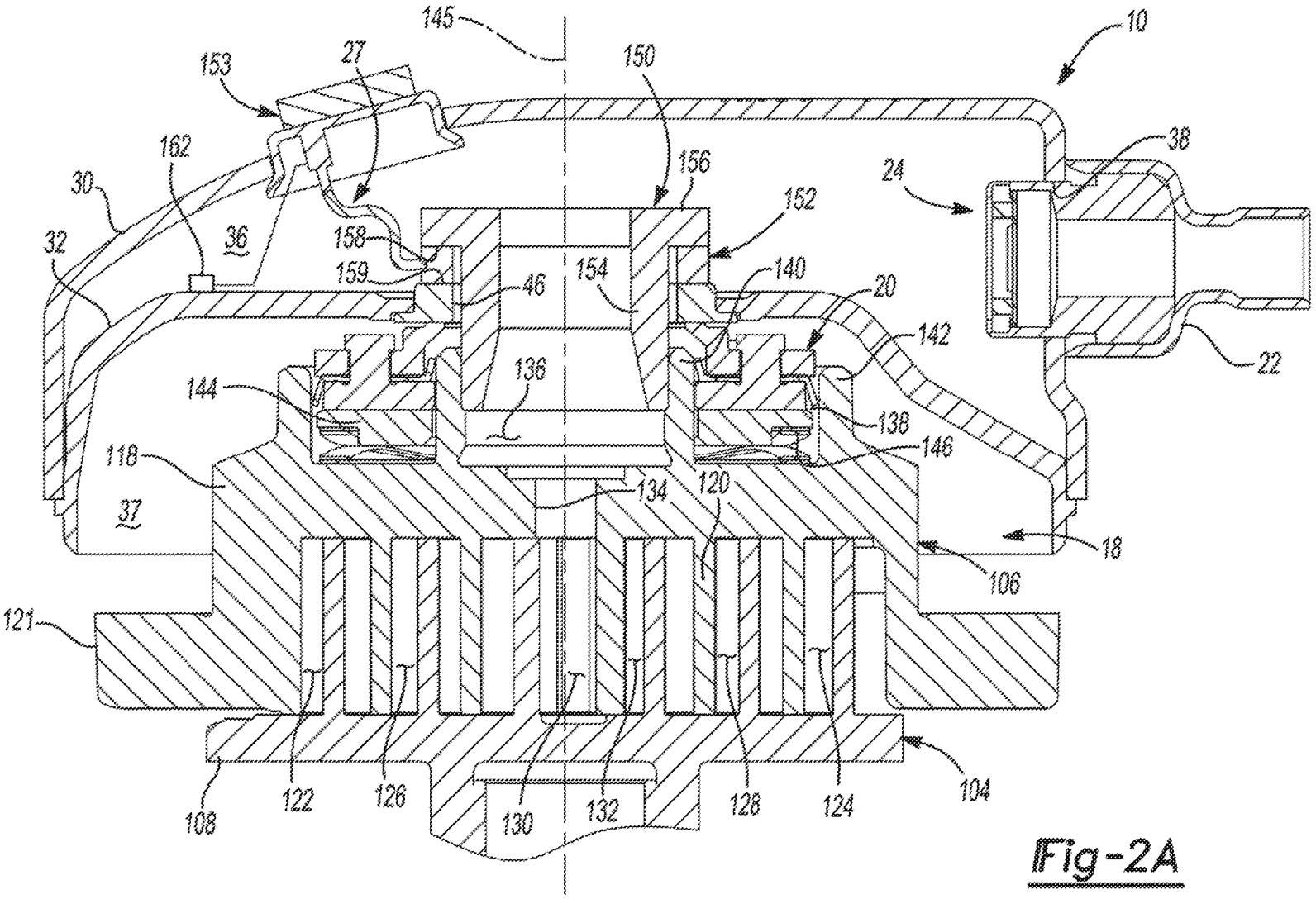
FIG. 2A is a partial cross-sectional view of the compressor of FIG. 1, the modulation system shown in a deactivated position causing the compressor to operate in a full load operating condition.
Figure 2B:
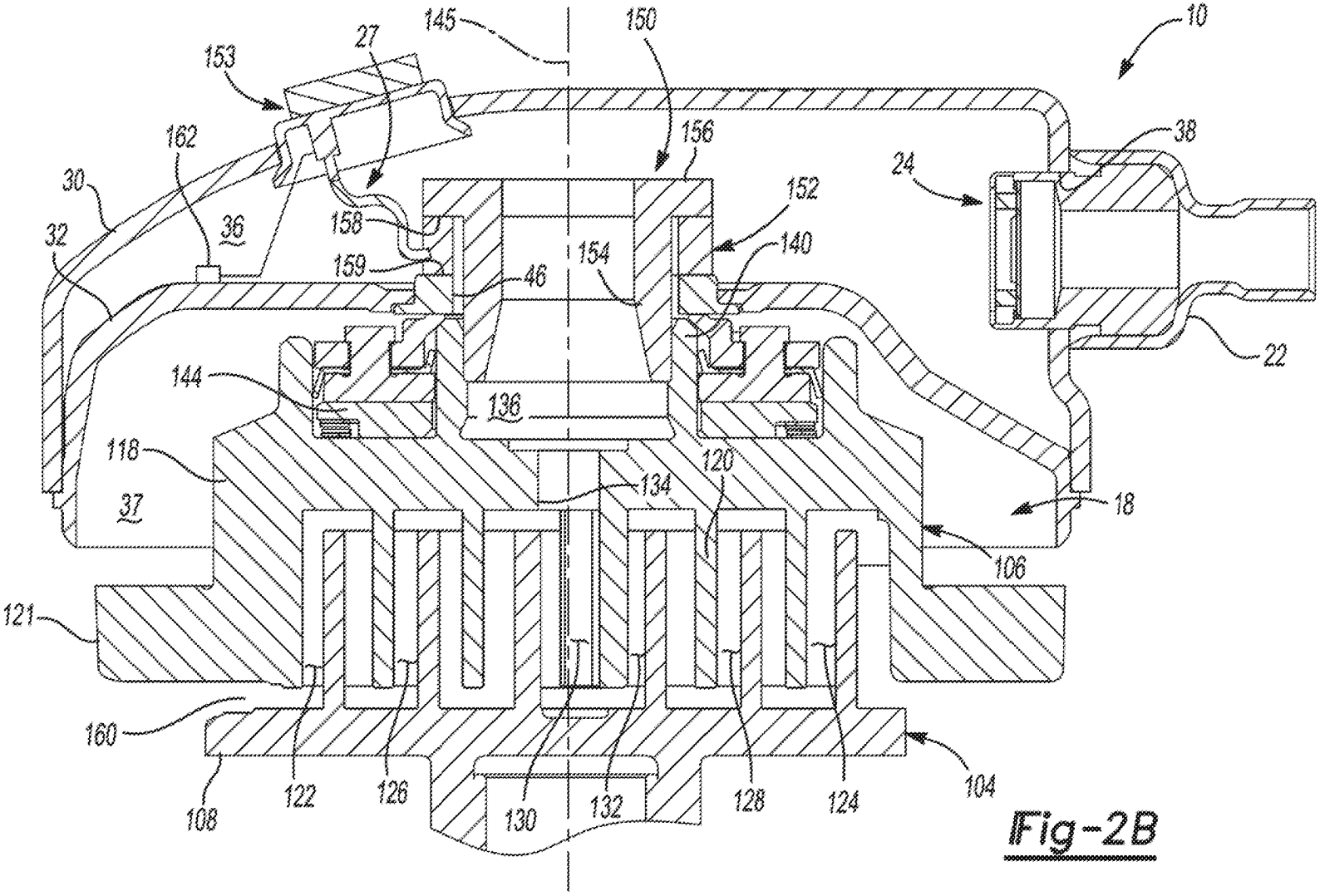
FIG. 2B is a partial cross-sectional view of the compressor of FIG. 1, the modulation system shown in an activated position causing the compressor to operate in a no load operating condition.
Figure 2C:
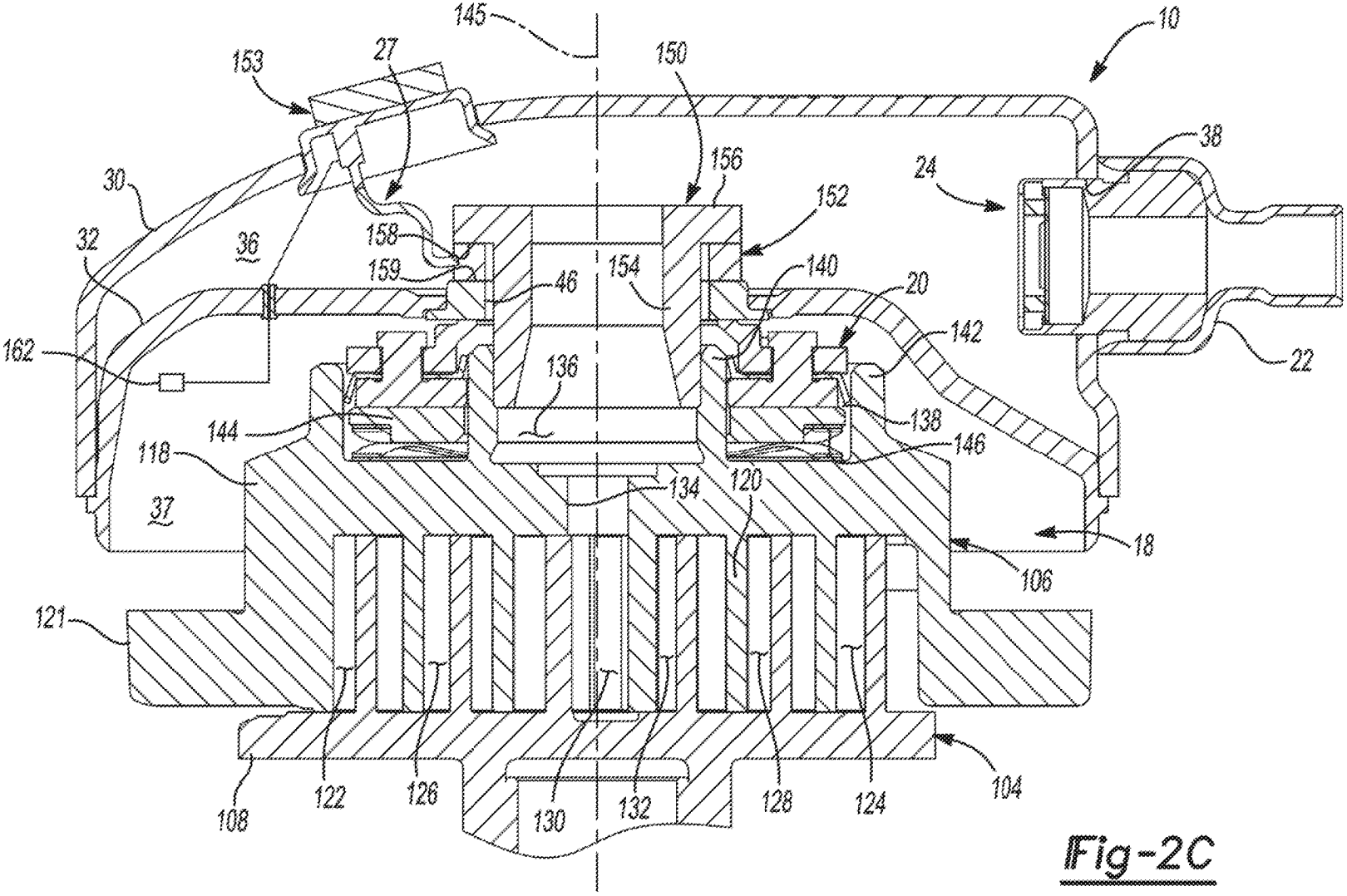
FIG. 2C is a partial cross-sectional view of a compressor incorporating another modulation system in accordance with the principles of the present disclosure.
Figure 2D:
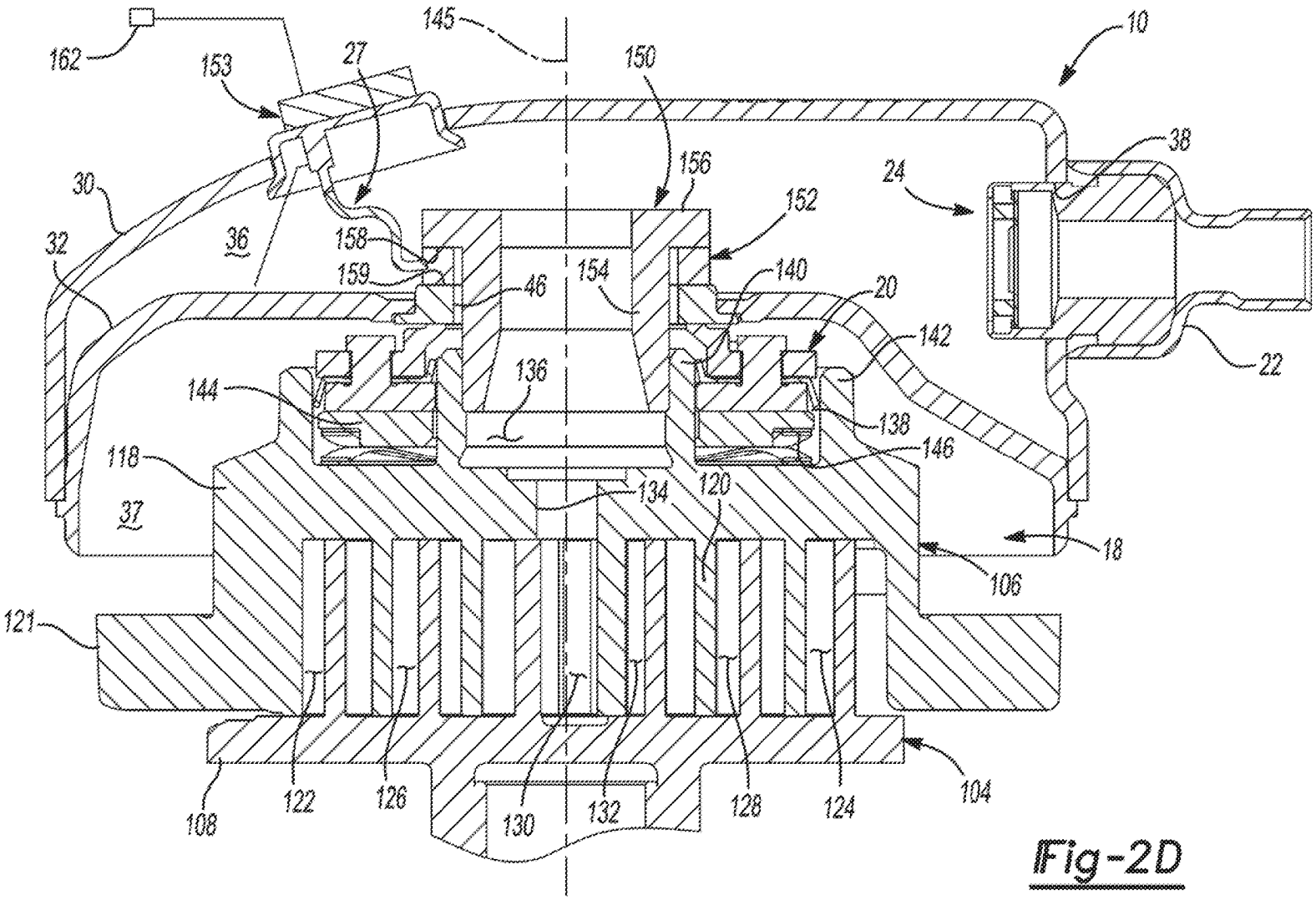
FIG. 2D is a partial cross-sectional view of a compressor incorporating yet another modulation system in accordance with the principles of the present disclosure.

The displacement member control module 153 may control the displacement member 152 based on an operating temperature of the compressor 10. In this regard, the modulation system 27 may also include a temperature sensor 162 in communication with the displacement member control module 153. With reference to FIGS. 2A and 2B, in some configurations, the temperature sensor 162 may be located in the discharge chamber 36. As illustrated in FIGS. 2C and 2D, respectively, in other configurations the temperature sensor 162 may be located in the suction chamber 37 or external to the compressor 10.

The temperature sensor 162 may sense an operating temperature of the compressor 10. As will be explained in more detail below, when the operating temperature exceeds a threshold operating temperature, the displacement member control module 153 controls the displacement member 152, such that the displacement member 152 moves the non-orbiting scroll 106 from the deactivated configuration (FIG. 2A) to the activated configuration (FIG. 2B).

Operation of the compressor 10 will now be described in more detail. When the displacement member 152 is deactivated (FIG. 2A), the compressor 10 may operate under full capacity. In this regard, when the displacement member 152 is deactivated, the spiral wrap 120 of the non-orbiting scroll 106 may engage the endplate 108 of the orbiting scroll 104.

During operation, it may become desirable to modulate or reduce the capacity of the compressor 10. In this regard, in some configurations, the displacement member control module 153 may activate the displacement member 152 in response to a signal received from the temperature sensor 162. In particular, the displacement member control module 153 may provide an electrical current to the displacement member 152. The electrical current may activate the thermally-responsive or shape-memory characteristics of the displacement member 152. For example, the electrical current may increase the temperature of the displacement member 152.

When the temperature of the displacement member 152 increases to a value that equals or exceeds the predetermined threshold temperature, the displacement member 152 may activate, as illustrated in FIG. 2B, and axially displace the hub 150 and the non-orbiting scroll 106 relative to the orbiting scroll 104. Accordingly, the spiral wrap 120 of the non-orbiting scroll 106 may define an axially-extending gap 160 with the endplate 108 of the orbiting scroll 104. The gap 160 allows the compressor 10 to operate under a no load condition in order to reduce the operating capacity of the compressor 10 to zero. When it is desirable to operate the compressor 10 at full capacity (e.g., 100% capacity), the displacement member control module 153 removes the electrical current from the displacement member 152 in order to reduce the temperature of the displacement member 152. When the temperature of the displacement member 152 is reduced to a value that is below the predetermined threshold temperature, the displacement member 152 may deactivate such that the displacement member 152 returns to the configuration illustrated in FIG. 2A.

During operation of the compressor 10, the modulation system 27 may cycle between the activated and deactivated states. In this regard, the electrical current being provided to the displacement member 152 may utilize pulse width modulation to cycle between "on" and "off" states. The cycling between the "on" and "off" states allows the modulation system 27 to cycle between a full load operating condition and an unloaded (e.g., no load) operating condition in order to reduce, and/or otherwise control, the operating capacity of the compressor 10.

In some configurations, the displacement member 152 can be or include a piezoelectric material and electric current supplied to the displacement member 152 may cause the displacement member 152 to activate its piezoelectric shape memory characteristics to axially displace the hub 150 and the non-orbiting scroll 106 relative to the orbiting scroll 104 (i.e., to the no-load position). When the operating temperature is below the threshold operating temperature, the displacement member control module 153 removes the electrical current from the displacement member 152 in order to return the displacement member 152, the hub 150 and the non-orbiting scroll 106 to the full-load position.

In yet another example, the displacement member 152 can be a magnetic shape memory material and the displacement member control module 153 can provide a magnetic field to the displacement member 152. The magnetic field may cause the displacement member 152 to activate its magnetic shape memory characteristics to axially displace the hub 150 and the non-orbiting scroll 106 relative to the orbiting scroll 104 (i.e., to the no-load position). When the operating temperature is below the threshold operating temperature, the displacement member control module 153 removes the magnetic field from the displacement member 152 in order to return the displacement member 152, the hub 150 and the non-orbiting scroll 106 to the full-load position.

Figure 3A:
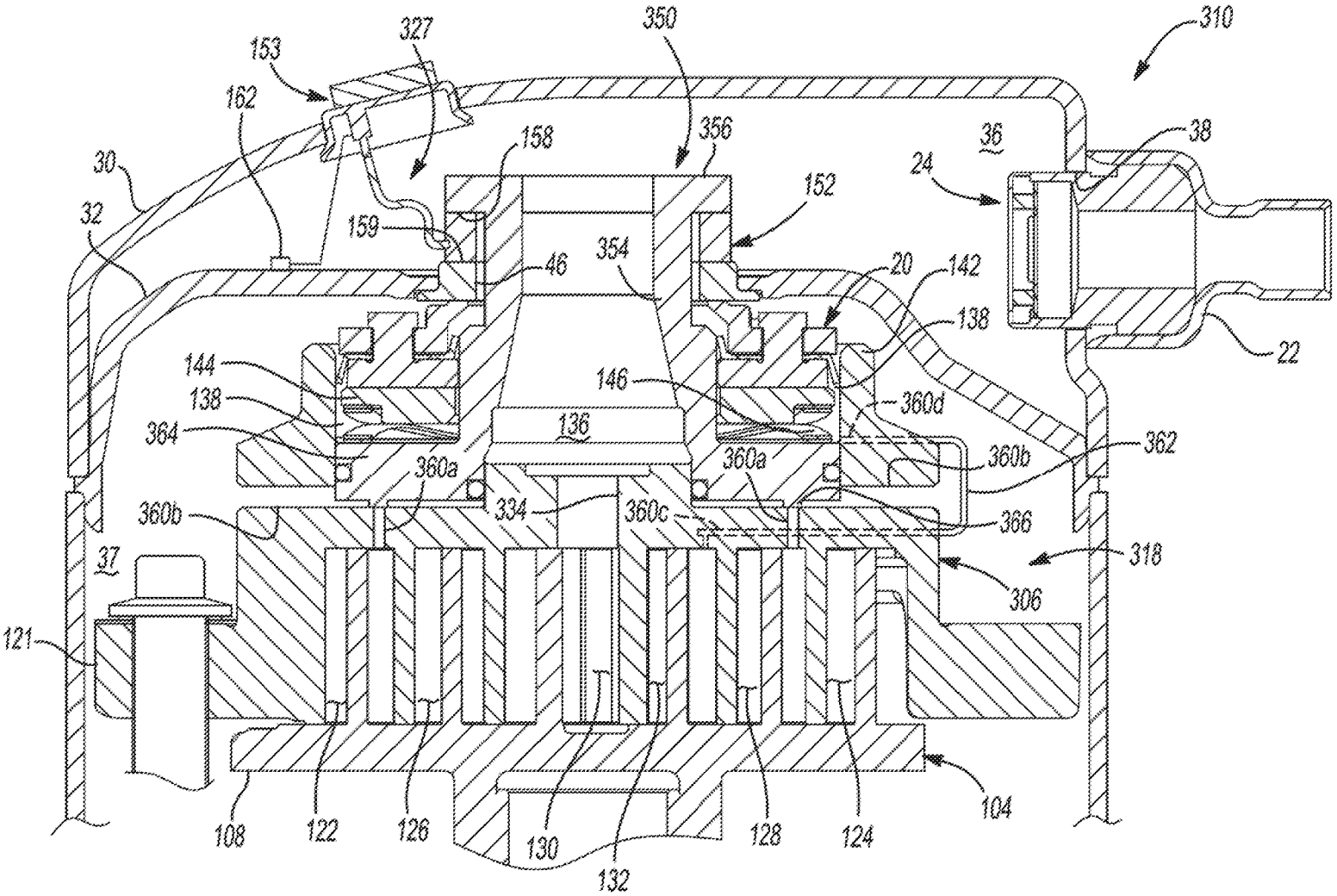
FIG. 3A is a partial cross-sectional view of another compressor incorporating another modulation system constructed in accordance with the principles of the present disclosure, the modulation system shown in a deactivated position causing the compressor to operate in a full load operating condition.
Figure 3B:
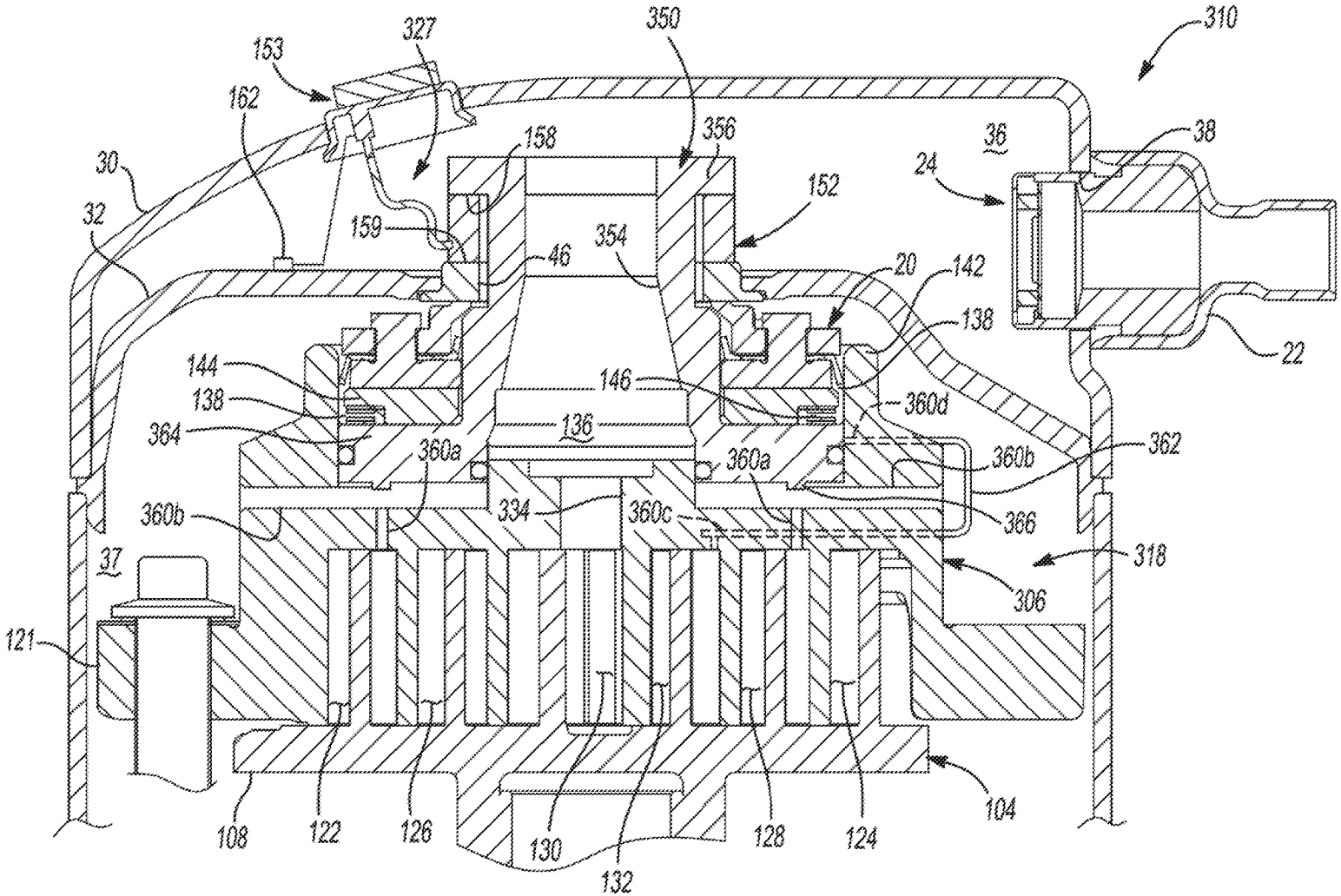
FIG. 3B is a partial cross-sectional view of the compressor of FIG. 3A, the modulation system shown in an activated position causing the compressor to operate in a partial load operating condition.
Figure 4:
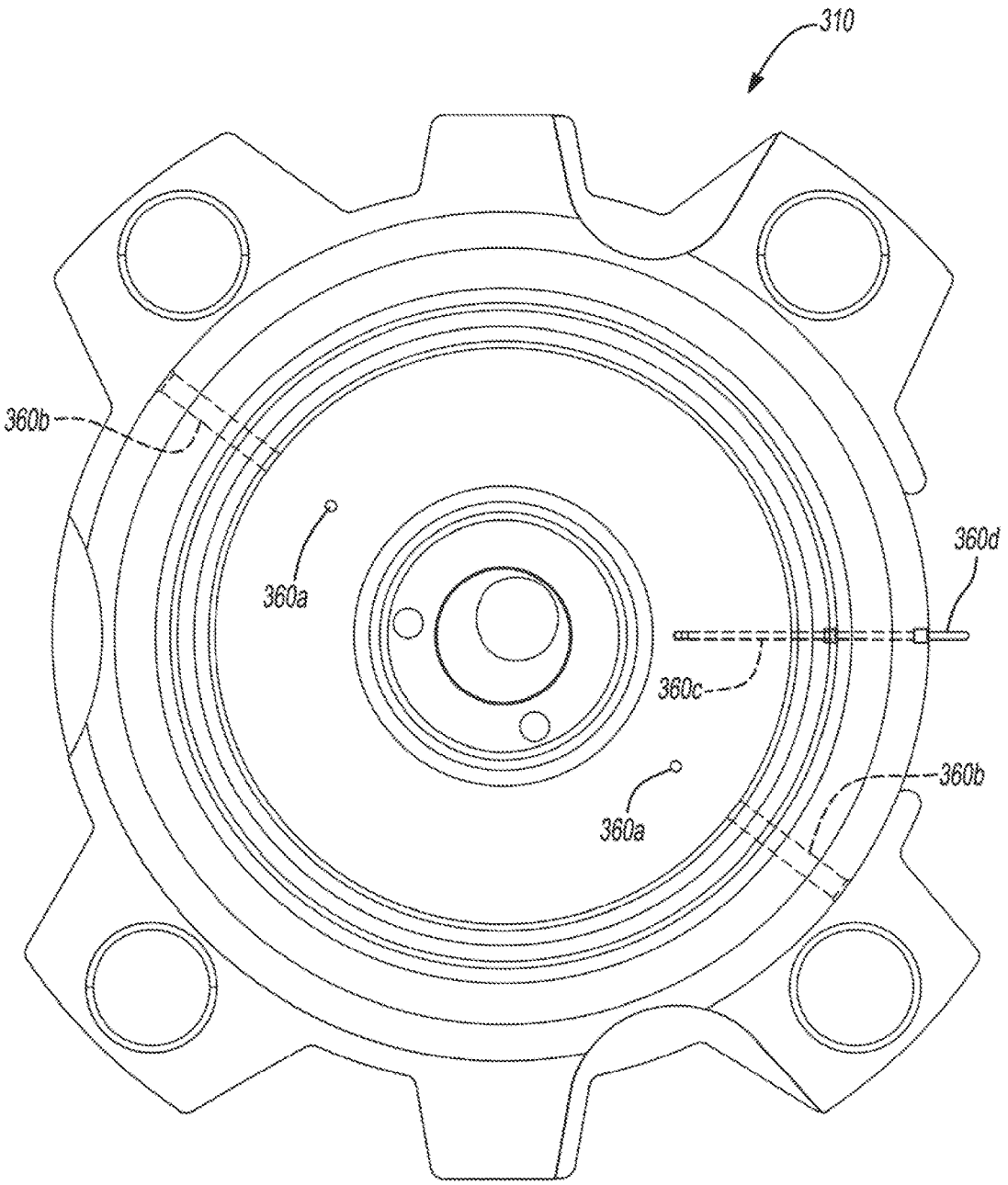
FIG. 4 is a top view of a compression mechanism of the compressor of FIG. 3A.

With reference to FIGS. 3A, 3B, and 4, a compressor 310 is shown. The structure and function of the compressor 310 may be substantially similar to that of the compressor 10 illustrated in FIGS. 1-2D, apart from any exceptions described below and/or shown in the Figures.

The compressor 310 may include a compression mechanism 318 and a capacity modulation system 327. The compression mechanism 318 may generally include the orbiting scroll 104 and a non-orbiting scroll 306. The non-orbiting scroll 306 may include an endplate 318 having the recess 136, the annular recess 138, and one or more modulation passages 360. In particular, the endplate 318 may include a first modulation passage 360*a*, a second modulation passage 360*b*, a first communication passage 360*c*, and a second communication passage 360*d*. In some configurations, the endplate 318 may include more than one of the first and second modulation passages 360*a*, 360*b* and more than one of the first and second communication passages 360*c*, 360*d*. For example, as illustrated in FIG. 4, in some configurations, the endplate 318 may include two first modulation passages 360*a*, two second modulation passages 360*b*, one first communication passage 360*c*, and one second communication passage 360*d*.

Each first passage 360*a* may extend axially and include one end in fluid communication with one or more of the compression pockets 122-132, and another end in fluid communication with one of the second passages 360*b*. Each second passage 360*b* may extend radially and include one end in fluid communication with one of the first passages 360*a*, and another end in fluid communication with the suction chamber 37. The first passage 360*c* may extend axially and/or radially and include one end in fluid communication with one of the compression pockets 122-132, and another end in fluid communication with the conduit 362. The second passage 360*d* may extend radially and include one end in fluid communication with the annular recess 138 and another end in fluid communication with the conduit 362. A conduit 362 may include one end in fluid communication with the first passage 360*c*, and another end in fluid communication with the second passage 360*d*, such that the first and second passages 360*c*, 360*d* are in fluid communication with the recess 138 and one of the compression pockets 122-132.

The modulation system 327 may include a hub 350 (e.g., a modulation member), the displacement member 152, and the displacement member control module 153. The hub 350 may include a base 364, an axially extending portion 354, and a radially outwardly extending flange 356. The base 364 may extend radially outwardly from the axially extending portion 354 and may be translatably and sealingly disposed within the annular recess 138. The base 364 may include an axially extending flange 366. In some configurations, the axially extending flange 366 may extend annularly about the base 364. As will be explained in more detail below, during operation the flange 366 may be configured to sealingly engage the first passage(s) 360*a* in order to selectively inhibit fluid communication between the first passage(s) 360*a* and the second passage(s) 360*b*.

The displacement member 152 may be disposed radially outwardly of the hub 350. In an assembled configuration, the displacement member 152 may be disposed axially between the flange 356 and the partition 32, and the flange 356 may be disposed axially between the partition 32 and the end cap 30. Accordingly, as will be explained in more detail below, the displacement member 152 can axially displace the hub 350 relative to the non-orbiting scroll 306, the shell assembly 12, and the partition 32.

Operation of the compressor 310 will now be described in more detail. During operation, working fluid (e.g., vapor at an intermediate pressure that is greater than a pressure in the suction chamber 37) may flow from one or more of the compression pockets 122-130 to the annular recess 138 through the first and second passages 360*c*, 360*d* and the conduit 362. When the displacement member 152 is deactivated (FIG. 3A), the compressor 310 may operate under full capacity. In this regard, the biasing member 146 and the intermediate pressure within the annular recess 138 may bias the hub 350 and the flange 366 into sealing engagement with the first passage(s) 360*a*. The biasing member 146 and the intermediate pressure within the annular recess 138 may further bias the seal assembly 20 into sealing engagement with the partition 32. Accordingly, when the displacement member 152 is deactivated, the seal assembly 20 and the hub 350, including the flange 366, may inhibit fluid communication between the suction chamber 37 and one or more of the compression pockets 122-130.

During operation, it may become desirable to modulate or reduce the capacity of the compressor 310. In this regard, in some configurations, the displacement member control module 153 may activate the displacement member 152 in response to a signal received from the selectively located temperature sensor 162, as previously described. In particular, the displacement member control module 153 may provide an electrical current to the displacement member 152. The electrical current may activate the thermally-responsive or shape-memory characteristics of the displacement member 152. For example, the electrical current may increase the temperature of the displacement member 152.

When the temperature of the displacement member 152 increases to a value that equals or exceeds the predetermined threshold temperature, the displacement member 152 may activate, as illustrated in FIG. 3B, and axially displace the hub 350 relative to the non-orbiting scroll 106. In this regard, when the displacement member 152 is activated, the hub 350 may translate upward (relative to the view in FIG. 3B) within the annular recess 138 such that the first passage(s) 360*a* is in fluid communication with the second passage(s) 360*b*, thus allowing one or more of the compression pockets 122-132 to fluidly communicate with the suction chamber 37. Accordingly, when the displacement member 152 is activated, the compressor 310 may operate at a reduced capacity.

When it is desirable to operate the compressor 310 at full capacity, the displacement member control module 153 removes the electrical current from the displacement member 152 in order to reduce the temperature of the displacement member 152. When the temperature of the displacement member 152 is reduced to a value that is below the predetermined threshold temperature, the displacement member 152 may deactivate such that the displacement member 152 returns to the configuration illustrated in FIG. 3A.

Operation of the compressor 310, may also utilize pulse width modulation to cycle between full and reduced capacity. The cycling between the full and reduced states allows the modulation system 327 to cycle between full and reduced load operating conditions in order to reduce, and/or otherwise control, the operating capacity of the compressor 310.

Figure 5A:
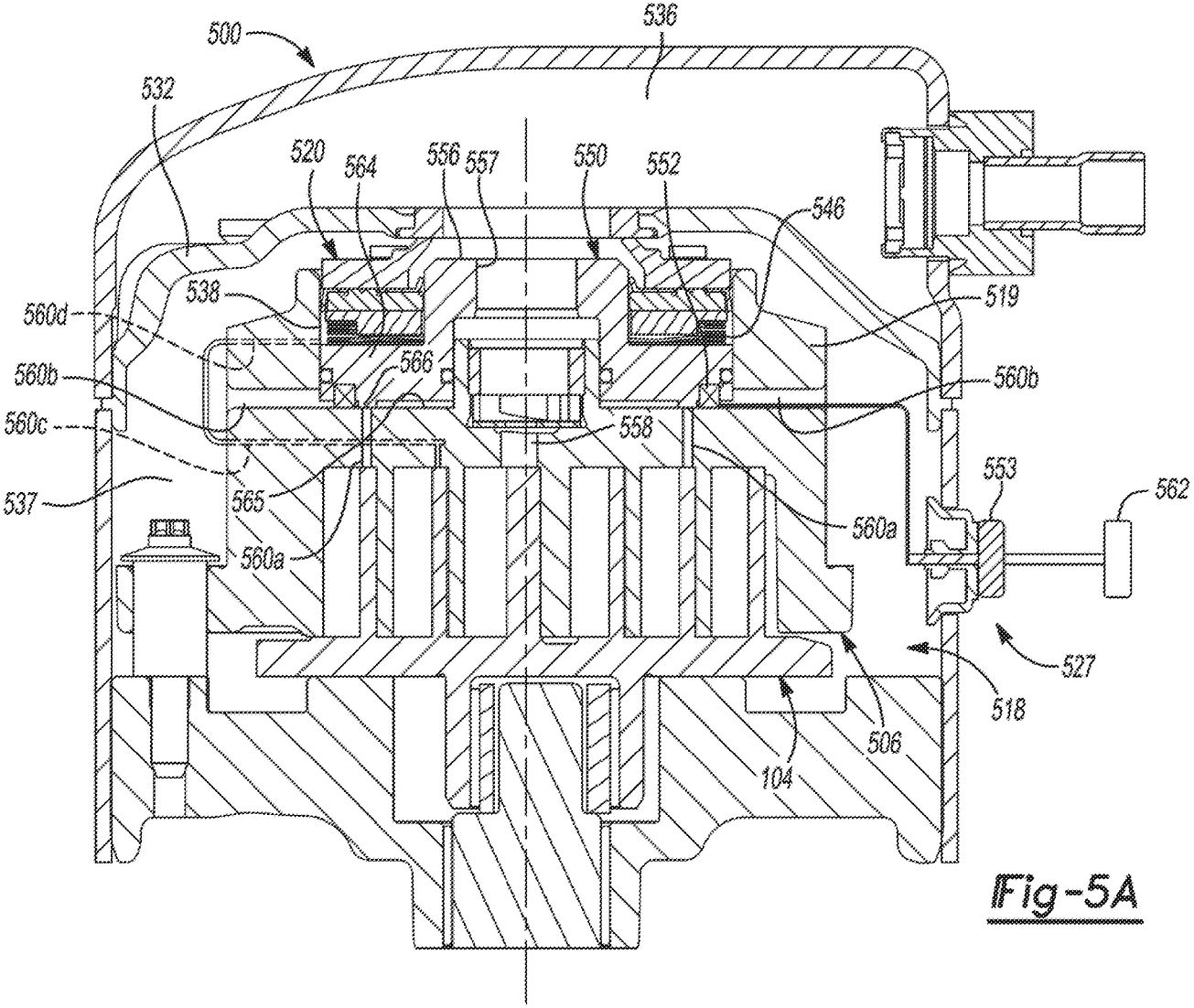
FIG. 5A is a partial cross-sectional view of another compressor incorporating another modulation system constructed in accordance with the principles of the present disclosure, the modulation system shown in a deactivated position causing the compressor to operate in a full load operating condition.
Figure 5B:
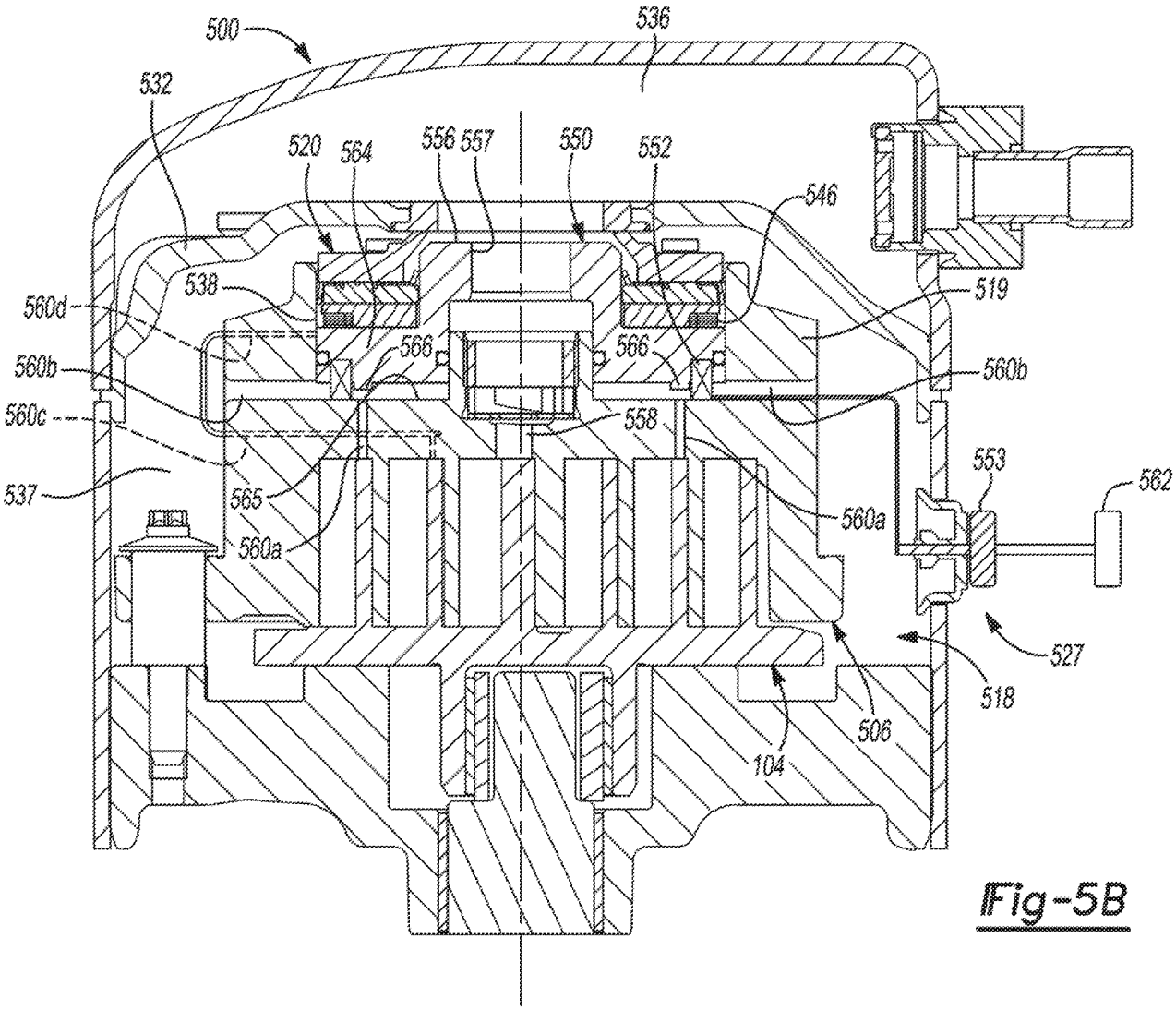
FIG. 5B is a partial cross-sectional view of the compressor of FIG. 5A, the modulation system shown in an activated position causing the compressor to operate in a partial load operating condition.

Referring now to FIGS. 5A and 5B, another compressor 500 is provided that may include a compression mechanism 518 and a capacity modulation system 527. The structure and function of the compression mechanism 518 and modulation system 527 may be similar or identical to that of the compression mechanism 318 and modulation system 327 described above, apart from any exceptions described below.

The compression mechanism 518 may generally include the orbiting scroll 104 and a non-orbiting scroll 506. Like the non-orbiting scroll 306, the non-orbiting scroll 506 may include an endplate 519 having an annular recess 538, one or more first modulation passages 560*a*, one or more second modulation passages 560*b*, one or more first communication passages 560*c*, and one or more second communication passages 560*d*.

The modulation system 527 may include a hub 550 (e.g., a modulation member), a displacement member 552, and a displacement member control module 553. The hub 550 may include a base 564 and a radially inwardly extending flange 556. The flange 556 may define a passageway 557 through which working fluid may be communicated between a discharge passage 558 of the non-orbiting scroll 506 and a discharge chamber 536. The base 564 may be translatably and sealingly disposed within the recess 538 of the non-orbiting scroll 506. The base 564 may include an annular, axially extending flange 566. During operation, the flange 566 may selectively sealingly engage the first passages 560*a* in order to selectively inhibit fluid communication between the first passages 560*a* and the second passages 560*b*. A seal assembly 520 (similar or identical to the seal assembly 20) may be disposed in a recess formed between the hub 550 and the endplate 519 and sealingly engages the hub 550 and the endplate 519. The seal assembly 520 is disposed axially between the base 564 and a partition 532.

The displacement member 552 may be similar or identical to the displacement member 152 described above and may be disposed axially between the base 564 of the hub 550 and a portion of the endplate 519 (e.g., an axially facing surface 565 of the endplate 519 that defines the recess 538). The displacement member control module 553 may control the displacement member 552 based on a temperature within the compressor 500 (e.g., within the discharge or suction chambers 536, 537) or based on a temperature outside of the compressor 500 (e.g., in a space to be cooled by a system in which the compressor 500 is installed). In this regard, the modulation system 527 may also include a temperature sensor 562 in communication with the displacement member control module 553.

As described above, when the temperature sensed by the temperature sensor 562 exceeds a threshold temperature, the displacement member control module 553 may cause the displacement member 552 to move the hub 550 axially away from the surface 565 and toward the partition 532, thereby moving the axially extending flange 566 out of sealing engagement with the first passages 560*a* (as shown in FIG. 5B) to allow fluid communication between the first passages 560*a* and the second passages 560*b*. Such fluid communication allows working fluid within an intermediate-pressure compression pocket to leak into the suction chamber 537, thereby unloading the compression mechanism 518. When the temperature sensed by the temperature sensor 562 is below the threshold temperature, a biasing member 546 (e.g., an annular wave spring) disposed between the seal assembly 520 and the base 564 may force the hub 550 axially downward so that the axially extending flange 566 seals off the first passages 560*a* (as shown in FIG. 5A), thereby allowing the compressor 500 to operate at full load. In some configurations, the displacement member control module 553 may pulse-width-modulate the displacement member 552 to cycle the modulation system 527 between the full-load and partial-load conditions to reduce and/or otherwise control the operating capacity of the compressor 500.

Referring now to FIGS. 6A and 6B, another compressor 600 is provided that may include a compression mechanism 618 and a capacity modulation system 627. The structure and function of the compression mechanism 618 and modulation system 627 may be similar or identical to that of the compression mechanism 18 and modulation system 27 described above, apart from any exceptions described below.

Like the compression mechanism 18, the compression mechanism 618 may include an orbiting scroll 604 and a non-orbiting scroll 606. The non-orbiting scroll 606 may include an endplate 619 having a spiral wrap 620 on a lower surface thereof and one or more radially outwardly extending flanged portions 621. The non-orbiting scroll 606 may be axially displaceable relative to a main bearing housing 614, shell assembly 612, and the orbiting scroll 604. The flanged portions 621 may include openings 639 that slidably receive bushings 655 therein. Fasteners 657 may be engaged with the main bearing housing 614 and the bushings 655 may generally form a guide for axial displacement of the non-orbiting scroll 606 relative to the main bearing housing 614, shell assembly 612 and orbiting scroll 604. The non-orbiting scroll 606 may also include an annular recess 638 in an upper surface of the endplate 619. The annular recess 638 may at least partially receive a seal assembly 622 (similar or identical to the seal assembly 20).

The modulation system 627 may include a displacement member 652, and a displacement member control module 653. The displacement member 652 may be similar or identical to the displacement member 152, 552 described above and may be disposed axially between the endplate 619 and the main bearing housing 614. Like the displacement member control module 153, 553, the displacement member control module 653 may control the displacement member 652 based on a temperature within the compressor 600 (e.g., within discharge or suction chambers 636, 637) or based on a temperature outside of the compressor 600 (e.g., in a space to be cooled by a system in which the compressor 600 is installed). In this regard, the modulation system 627 may also include a temperature sensor 662 in communication with the displacement member control module 653.

As described above, when the temperature sensed by the temperature sensor 662 exceeds a threshold temperature, the displacement member control module 653 may cause the displacement member 652 to move the non-orbiting scroll 606 axially away from the main bearing housing 614 and toward partition 632, thereby separating tips of the spiral wrap 620 of the non-orbiting scroll 606 from endplate 623 of the orbiting scroll 604 and separating tips of spiral wrap 625 of the orbiting scroll 604 from the endplate 619 of the non-orbiting scroll 606 (as shown in FIG. 6B) to allow fluid within compression pockets between the spiral wraps 620, 625 to leak into the suction chamber 637, thereby unloading the compression mechanism 618. When the temperature sensed by the temperature sensor 662 is below the threshold temperature, a biasing member 646 (e.g., an annular wave spring) disposed between the seal assembly 622 and the endplate 619 may force the endplate 619 axially downward so that the tips of the spiral wrap 620 of the non-orbiting scroll 606 can seal against the endplate 623 of the orbiting scroll 604 and the tips of spiral wrap 625 of the orbiting scroll 604 can seal against the endplate 619 of the non-orbiting scroll 606 (as shown in FIG. 6A), thereby allowing the compressor 600 to operate at full load. In some configurations, the displacement member control module 653 may pulse-width-modulate the displacement member 652 to cycle the modulation system 627 between the full-load and no-load conditions to reduce and/or otherwise control the operating capacity of the compressor 600.

In this application, including the definitions below, the term "module" may be replaced with the term "circuit." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The descriptions above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language) or XML (extensible markup language), (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective C, Haskell, Go, SQL, R, Lisp, Java®, Fortran, Perl, Pascal, Curl, OCaml, Javascript®, HTML5, Ada, ASP (active server pages), PHP, Scala, Eiffel, Smalltalk, Erlang, Ruby, Flash®, Visual Basic®, Lua, and Python®.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A compressor comprising:

a first scroll including a first endplate and a first spiral wrap;

a second scroll including a second endplate and a second spiral wrap interleaved with said first spiral wrap and cooperating to form a plurality of working fluid pockets therebetween, said first endplate including a first passage and a second passage, said first passage in communication with an intermediate one of said working fluid pockets; and a modulation system including a modulation member and a temperature-responsive displacement member, said modulation member engaging said first endplate and movable relative to said first endplate between a first position in which said modulation member blocks communication between said first and second passages and a second position in which said modulation member is spaced apart from said first passage to allow communication between said first and second passages, said temperature-responsive displacement member engaging said modulation member and actuating to axially move said modulation member between said first and second positions.

2. The compressor of claim 1, wherein said modulation member is an annular hub that at least partially defines a discharge passage through which discharge-pressure working fluid enters a discharge chamber of the compressor.

3. The compressor of claim 2, wherein said modulation member includes a base portion having a protrusion extending axially therefrom, and wherein said protrusion seals said first passage when said modulation member is in said first position.

4. The compressor of claim 3, wherein said first passage extends axially through said first endplate, and wherein said second passage extends radially through said first endplate.

5. The compressor of claim 4, further comprising a seal assembly and a biasing member, said seal assembly disposed within an annular recess of said first scroll, said biasing member disposed between said seal assembly and said first endplate and biasing said seal assembly into sealing engagement with a partition separating a discharge chamber from a suction chamber, said biasing member biasing said first scroll axially toward said second scroll.

6. The compressor of claim 1, wherein said temperature-responsive displacement member is disposed between and engages said modulation member and an axially facing surface of said first endplate.

7. The compressor of claim 1, wherein said temperature-responsive displacement member is disposed between and engages said modulation member and a partition separating a discharge chamber from a suction chamber.

8. The compressor of claim 1, wherein said modulation system includes a control module in communication with said temperature-responsive displacement member and a temperature sensor, said temperature sensor disposed within one of a discharge chamber of the compressor, a suction chamber and a location outside of the compressor.

9. The compressor of claim 1, wherein the temperature-responsive displacement member includes a shape memory material.

10. The compressor of claim 9, wherein the shape memory material includes at least one of a bi-metal and tri-metal shape memory alloy.

11. The compressor of claim 9, wherein said temperature-responsive displacement member is actuated when an electrical current is applied to said shape memory material.

* * * * *